United States Patent [19]

Robinson, Jr. et al.

[11] 4,009,587

[45] Mar. 1, 1977

[54] COMBINED LOOP FREE-PISTON HEAT PUMP

[75] Inventors: Glen P. Robinson, Jr., Atlanta; Samuel V. Shelton, Stone Mountain, both of Ga.

[73] Assignee: Scientific-Atlanta, Inc., Atlanta, Ga.

[22] Filed: Apr. 7, 1975

[21] Appl. No.: 565,629

Related U.S. Application Data

[63] Continuation-in-part of Ser. No. 550,413, Feb. 18, 1975.

[52] U.S. Cl. ..... 62/116; 62/2; 62/498; 62/501

[51] Int. Cl.[2] ..... F25B 1/00; F25B 27/00

[58] Field of Search ..... 62/2, 116, 501, 498, 62/500, 476

[56] References Cited

UNITED STATES PATENTS

| | | | |
|---|---|---|---|
| 871,325 | 11/1907 | Coleman | 62/501 |
| 1,353,216 | 9/1920 | Carlson | 62/501 |
| 2,039,999 | 5/1936 | Holyfield | 62/501 |
| 2,991,632 | 7/1961 | Rogers | 62/498 |
| 3,172,270 | 3/1965 | Mirante | 62/116 |
| 3,708,996 | 1/1973 | Wurm | 62/116 |
| 3,763,663 | 10/1973 | Schlichtig | 62/116 |

FOREIGN PATENTS OR APPLICATIONS

| | | | |
|---|---|---|---|
| 571,372 | 8/1945 | United Kingdom | 62/501 |

*Primary Examiner*—Lloyd L. King
*Attorney, Agent, or Firm*—B. J. Powell

[57] ABSTRACT

A heat pump system including an evaporator with an inlet and an outlet, a condenser with an inlet and an outlet, a boiler with an inlet and an outlet, an expansion valve connecting the condenser outlet to the evaporator inlet, a liquid pump connecting the condenser outlet to the boiler inlet, and a system working fluid in combination with an expansion-compression device defining a chamber therein and including a free-piston slidably carried in the chamber for linear movement therein, and dividing the chamber into a first subchamber of varying size as said free piston moves and a second subchamber of varying size as said free piston moves along with boiler valve means for selectively introducing working fluid from the boiler outlet into the first subchamber; valve means for selectively introducing working fluid from the evaporator outlet into the first subchamber; condenser valve means for selectively introducing working fluid from said first subchamber into the condenser inlet; means for pressurizing the second subchamber to urge said free piston toward said first subchamber; and control means for selectively causing the boiler valve means to introduce working fluid from the boiler into the first subchamber to drive the free piston toward the second subchamber, for causing the evaporator valve means to introduce working fluid from the evaporator into said first subchamber when the pressure in the first subchamber drops below the pressure in the evaporator, and for selectively causing the condenser valve means to connect the first subchamber to the condenser inlet when said free piston moves toward the first subchamber and when the pressure in the first subchamber rises to the pressure in the condenser. The disclosure also contemplates the operation of the system and the specific construction and operation of the boiler valves and condenser valves.

17 Claims, 11 Drawing Figures

COMBINED LOOP FREE-PISTON HEAT PUMP

CROSS-REFERENCE TO RELATED APPLICATIONS

This application is a continuation-in-part of our copending application Ser. No. 550,413, filed Feb. 18, 1975 for "Dual Loop Heat Pump System".

BACKGROUND OF THE INVENTION

Because of lack of fuel for combustion processes, alternatives are being sought for electrically driven heat pump systems or heat driven heat pump systems using combustion processes to supply the necessary heat to drive the system. One alternative that has been suggested is to use solar energy to supply the necessary heat to drive a heat driven heat pump system rather than a combustion process. Two general types of heat driven, heat pump systems are available. The first type is an absorption system which uses heat to boil a refrigerant out of a carrier liquid in a boiler generator, passes the refrigerant through a condenser and an evaporator, and then recombines the refrigerant with the carrier liquid for recycling in an absorber. The second type is a dual loop system that has a power loop in which the power loop working fluid is heated and used to power an expansion-compression device. The heat pump loop of such systems is connected to the compression side of the expansion-compression device and operates on the vapor compression cycle.

With an absorption system, the minimum temperature required to operate such a system is relatively high. Presently available solar energy collection systems, on the other hand, are able to obtain this relatively high operating temperature required for an absorption system for only a short period of time during a 24 hour period under the best of conditions and in many instances not at all. This has required the use of a large collector associated with a thermal storage system to collect and store the high temperature heat energy when available for later use or a combustion process to supplement the heat obtained from solar energy for most of the required operating time of the absorption system thus making it uneconomical to use solar energy to drive an absorption system especially when the initial installation cost is considered.

One heat driven dual loop system that has been suggested uses a linear motion free-piston expansion-compression device such as that disclosed in U.S. Pat. Nos. 2,637,981 and 3,861,166. These free-pisotn expansion-compression devices have been able to operate effectively and efficiently only within very limited temperature ranges of heat input and in order to obtain reasonable efficiencies have also required relatively high minimum temperatures to drive the system. Because the heat output capability from presently available solar energy collection systems always varies widely over a 24 hour period and also because these solar energy collection systems are able to collect heat at the required relatively high operating temperatures required for the dual loop system for only a short period of time during a 24 hour period under the best of conditions, it has been necessary to use a large collector associated with a thermal storage system to collect and store the high temperature heat energy when available for later use or a combustion process to supplement the heat obtained from solar energy for most of the required operating time of the system. Thus, like the absorption system, solar energy has been unable to economically drive a dual loop heat pump system with an expansion-compression device.

SUMMARY OF THE INVENTION

These and other problems and disadvantages associated with the prior art are overcome by the invention disclosed herein by providing a heat driven, dual loop heat pump system with an expansion-compression device which can be operated on relatively low temperatures and pressures in the power loop working fluid. Such temperatures and pressures are within the capability of a solar energy collection system to heat the working fluid in the power loop. Further, the system is normally operated over wide temperature ranges without irreversible throttling processes thereby increasing its operational efficiency. Also, the invention has the capability of operating over a wide temperature and pressure range in the working fluid of the power loop without irreversible throttling processes maximizing the efficiency over the entire system range, especially important when using solar energy to drive same. The kinetic energy temperarily stored in the linearly moving mass of the free-piston in the expansion-compression device is transmitted back into the working fluid of the system so that it is usually recovered and further prevents throttling losses. Further, the invention is simple in construction with a minimum of moving parts in the expansion-compression device and requires very little maintenance.

The apparatus of the system comprises an expansion-compression device with one or more free-pistons slidably carried therein. Each free piston is selectively connected to the power loop working fluid which operates according to the Rankine cycle and to the refrigeration or heat pump loop working fluid operated on a vapor compression cycle through an appropriate valve and control system. The valve and control system selectively associates the working fluid of the power loop with the free piston in the expansion-compression device to cause the power loop working fluid to drive the free piston linearly and induce linear kinetic energy in the free piston, to then associate the working fluid of the heat pump loop with the free piston while the kinetic energy is maintained therein so that the linear kinetic energy temporarily stored in the moving piston is transferred back into the working fluid of the system. The power loop includes a boiler which receives heat from a heat source such as a solar energy collector and transfers this heat to the power loop working fluid to drive the system, and the refrigeration or heat pump loop system includes an evaporator which receives the refrigeration or heat pump loop working fluid and transfers heat to the working fluid in the heat pump loop from an outside medium. The power loop and the refrigeration or heat pump loop share a condenser which receives both the power loop working fluid and the refrigeration or heat pump loop working fluid therein to cool the system working fluid by transferring heat therefrom to an outside medium.

The method of the invention is directed to the operation of a dual loop, heat pump system with an expansion-compression device having a linearly movable piston therein, a Rankine cycle power loop driving the expansion-compression device and a vapor compression heat pump loop driven by the expansion-compression device which includes the steps of selectively associating the working fluid of the power loop with the linearly movable piston of the expansion-compression device to cause the power loop working fluid to drive the free piston linearly and induce linear kinetic energy in the free piston and selectively associating the working fluid of the system with the free piston while the linear kinetic energy is stored therein to cause the kinetic energy of the free piston to be transferred back into the working fluid of the system as work of compression.

These and other features and advantages of the invention will become more clearly understood upon consideration of the following specification and accompanying drawings wherein like characters of reference designate corresponding parts throughout the several views and in which:

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figure 1:
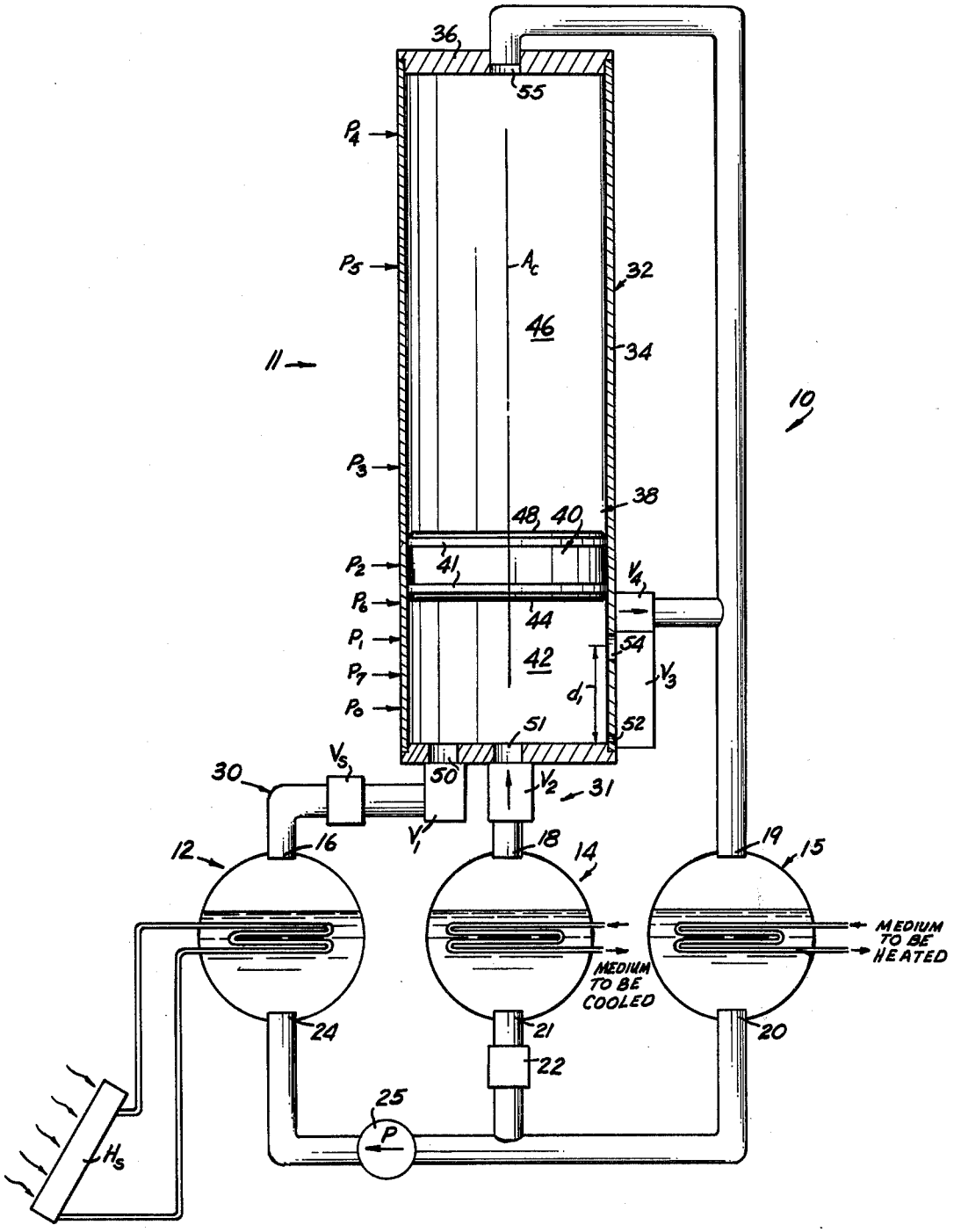
FIG. 1 is a schematic view of one embodiment of the inventon showing the expansion-compression device in cross-section.

Referring to FIG. 1, it will be seen that the heat pump system 10 includes an expansion-compression device 11, a boiler 12, an evaportor 14 and a condenser 15. The outlet 16 of the boiler 12 is connected to the expansion-compression device 11 to drive same, the outlet 18 of the evaporator 14 is also connected to the expansion-compression device 11 to supply working fluid thereto which is to be compressed and the inlet 19 of the condenser 15 is connected to the expansion-compression device 11 to receive the compressed fluid therefrom. The outlet 20 of the condenser 15 is connected to the inlet 21 of the evaporator 14 through a conventional expansion valve 22 and the outlet 20 of the condenser 15 is also connected to the inlet 24 of the boiler 12 through a liquid pump 25. Thus, it will be seen that the system 10 uses a single working fluid and is a dual loop system with the boiler 12, expansion-compression device 11, and condenser 15 forming the power loop while the evaporator 14, expansion-compression device 11 and condenser 15 forming the heat pump or refrigeration loop. For sake of simplicity, the refrigeration or heat pump loop will be referred to hereinafter as a heat pump loop, it being understood that this terminology also includes the refrigeration loop since the only difference between a refrigeration loop and a heat pump loop is that the medium on which the temperature is desired to be controlled is cooled by the evaporator in a refrigeration loop and heated by the condenser in a heat pump loop. The Rankine cycle power loop has been designated generally 30 in FIG. 1 while the vapor compression cycle heat pump loop has been designated generally 31 in FIG. 1. The boiler 12 is in a heat exchange relation with a heat source $H_S$ such as a solar energy collector, the evaporator 14 is in a heat exchange relation with a medium which is to be cooled and the condenser 15 is in a heat exchange relation with the medium to be heated as is known in the heat pump art.

The expansion-compression device 11 is a free piston device which is driven by high pressure working fluid from the boiler 12 and compresses the system working fluid to discharge same to the condenser 15. The device 11 includes an elongate cylinder 32 with a central axis $A_C$. The cylinder 32 has a annular cylindrical side wall 34 closed at its lower end by end wall 35 and closed at its upper end by an end wall 36. A free piston 40 is slidably carried in the chamber 38 defined by the side wall 34 and the end walls 35 and 36 in sealing engagement with the side wall 34 through sealing rings 41 about the periphery of the free piston 40. It will thus be seen that the free piston 40 divides the chamber 38 into a working subchamber 42 between the lower face 44 of the piston 40 and the end wall 35 and a back-up subchamber 46 between the upper face 48 of the piston 40 and the end wall 36. The piston 40 is slidably movable within the cylinder 32 along the central axis $A_C$ so that both the working subchamber 42 and the back-up subchamber 46 vary in size as the piston moves linearly along the axis $A_C$. The piston 40 also has a prescribed weight.

The end wall 35 defines a boiler inlet port 50 therethrough which is connected to the outlet 16 of the boiler 12 througn boiler valve $V_1$, and an evaporator inlet port 51 which is connected to the outlet 18 of the evaporator 14 through the evaporator check valve $V_2$ that allows fluid to only flow from evaporator 14 into subchamber 42. The side wall 34 defines an actuation port 52 therethrough at the juncture of the side wall 34 with the end wall 35 and a condenser outlet port 54 therethrough spaced a prescribed distance $d_1$ inboard of the port 52. The port 54 is connected to the inlet 19 of the condenser 15 through a condenser control valve $V_3$ and a condenser check valve $V_4$ while the actuation port 52 is connected to the condenser control valve $V_3$ to control same. The end wall 36 defines a back-up port 55 therethrough which is in direct connection with the inlet 19 to the condenser 15.

The valves $V_1$–$V_4$ control the operation of the system. With mid point of the piston 40 at its lowermost positon $P_o$ shown in FIG. 1, the valves $V_2$–$V_4$ are closed and the boiler valve $V_1$ opens to introduce the high pressure working fluid from the boiler 12 into the working subchamber 42 to drive piston 40 toward the back-up subchamber 46 in an up stroke and accelerate the piston. The positions indicated are all taken from the mid point of piston 40. When the piston 40 reaches a predetermined velocity, at say position $P_1$, the boiler valve $V_1$ closes, however, the working fluid at boiler pressure in the working subchamber 42 is higher than the condenser pressure in the bakc-up subchamber 46 so that the working fluid at the boiler pressure in the working subchamber 42 is allowed to expand and continue to accelerate the piston 40 toward the back-up subchamber 46. When the working fluid in the working subchamber 42 has expanded sufficiently, say when the piston 40 reaches positon $P_2$, the pressure of the working fluid in the subchamber 42 reaches condenser pressure so that no further energy is added to the piston 40 by the working fluid in the subchamber 42. The piston 40, however, continues to move past position $P_2$ due to the linear kinetic energy stored in the piston 40.

As the piston 40 continues to move upwardly along the axis $A_C$, in its up stroke, the pressure of the working fluid in the working subchamber 42 drops below the pressure of the working fluid in the back-up subchamber 46 so that the net force on the piston 40 reverses to a downward force causing the piston 40 to decelerate since the linear kinetic energy in the free piston 40 is being consumed as flow work of compression. When the piston 40 reaches a certain position, say position $P_3$, the working fluid in the subchamber 42 has expanded slightly below the pressure of the working fluid in the evaporator 18 and the evaporator check valve $V_2$ connecting the outlet 18 of the evaporator 14 to the working subchamber 42 opens to allow working fluid from the evaporator 14 to be drawn into the working subchamber 42. At some later position, say position $P_4$, the piston 40 will have lost all of its linear kinetic energy and come to rest at the end of the up stroke. Now, however, the pressure in the back-up subchamber 46, being at condenser pressure, is higher than the pressure in the working subchamber 42, being at evaporator pressure. This causes the motion of the piston 40 to reverse with the working fluid in the back-up subchamber 46 accelerating the piston 40 downwardly in its down stroke. This causes the evaporator check valve $V_2$ to close to trap the working fluid in the subchamber 42 and cause the piston 40 to compress the working fluid in the subchamber 42 as it accelerates downwardly along the axis $A_C$. When the piston reaches some position, say position $P_5$, on its return down stroke toward the working subchamber 42, the pressure of the working fluid in the subchamber 42 will have been compressed up to condenser pressure.

At this point, valves $V_3$ and $V_4$ connect the working subchamber 42 to the inlet 19 of the condenser 15 so that the working fluid in the working subchamber 42 is expelled into the condenser 15. It will also be noted that the net force on the piston 40 has reached zero at position $P_5$, however, the linear kinetic energy stored in the piston 40 as it is accelerated from position $P_4$ to position $P_5$ continues to move the piston 40 downwardly toward the subchamber 42. As the piston 40 covers condenser outlet port 54 at position $P_6$, the valve $V_3$ closes to prevent the working fluid in the subchamber 42 from being further discharged into the condenser 15 so that the working fluid in the subchamber 42 is allowed to rise to a pressure sufficient to completely decelerate the piston 40 by the time it reaches another position, say position $P_7$, to limit the down stroke of the piston 40. It will be noted, however, that the pressure in the working subchamber 42 is now well above the pressure in the back-up subchamber 46 so that the piston reverses its travel under this pressure and starts movement back toward the back-up subchamber 46 in its up stroke. When the pressure in the working subchamber 42 has dropped back to the pressure of the working fluid in the boiler 12, the boiler valve $V_1$ is again opened to accelerate the piston and the cycle repeated.

BOILER VALVE

Figure 2:
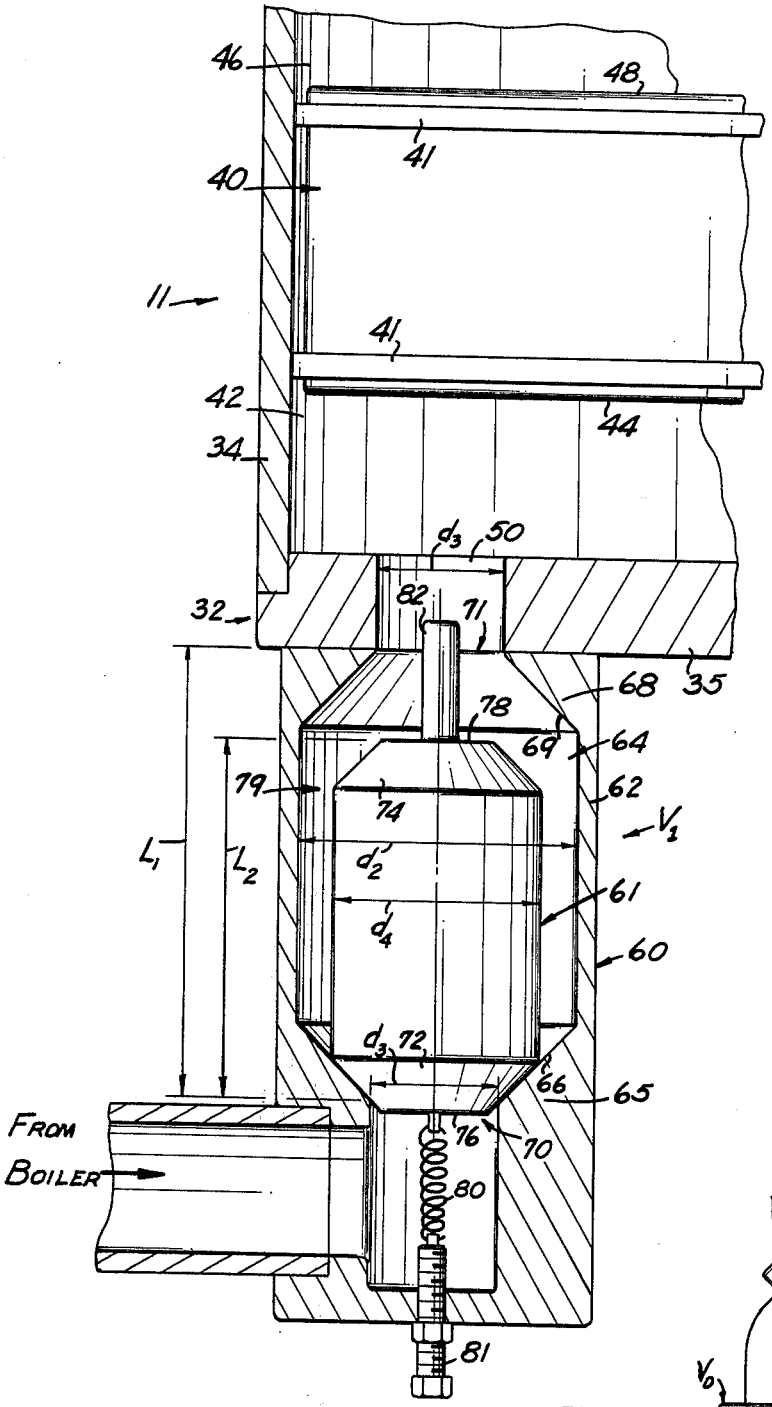
FIG. 2 is an enlarged cross-sectional view of one embodiment of the boiler valve of the invention.

Referring to FIG. 2, the construction of the boiler valve $V_1$ is illustrated in detail. The valve $V_1$ is designed to introduce the working fluid from the boiler 12 into the working subchamber 42 of the expansion-compression device 11 upon activation and to continue to introduce the working fluid from the boiler 12 into the subchamber 42 until the piston 12 has a predetermined linear kinetic energy induced therein. Because the velocity of the free piston 40 determines the linear kinetic energy induced therein and because the rate at which the volume of the working subchamber 42 is increasing is directly proportional to the velocity of the free piston 40, the velocity of the working fluid from the boiler 12 entering the subchamber 42 is an indication of the velocity of the piston 40. The velocity of the working fluid from the boiler 12 is thus used to close the boiler valve $V_1$ since this velocity is an indication of the velocity, and thus, the linear kinetic energy, of the piston 40.

The boiler valve $V_1$ includes a tubular housing 60 which mounts a valve body 61 therein for movement between an upward position blocking the flow of boiler fluid into the subchamber 42 to a lower position blocking the flow of the working fluid from the working subchamber 42 to the boiler. The housing 60 has a cylindrical side wall 62 defining a valve chamber 64 therein of diameter $d_2$ with a lower inwardly tapered section 65 forming a valve seat 66 on the inside thereof and an upper inwardly tapering section 68 forming a valve seat 69 on the inside thereof. The valve seat 66 defines an inlet opening 70 therethrough of diameter $d_3$ and the upper valve seat 69 also defines an outlet opening 71 therethrough of the diameter $d_3$.

The valve body 61 is cylindrical with a diameter $d_4$ less than the diameter $d_2$ and has an inwardly tapered seating surface 72 at the lower end thereof adapted to seat on the lower valve seat 66 in sealing relationship therewith when the body moves downwardly in housing 60. The upper end of the valve body 61 has also an inwardly tapering seating surface 74 adapted to engage the upper valve seat 69 in sealing engagement therewith when the body 61 moves upwardly in the housing 60. It will be noted that the valve chamber 64 has a length $L_1$ greater than the length $L_2$ between the lower face 76 of the body 61 and the upper face 78 of the body 61. The relationship between the diameters $d_2$ and $d_4$ is such that the cross-sectional area of the annular passage 79 between the body 61 and the side wall 62 is such that flow through this passage produces a pressure drop. It will also be noted that the inlet opening 70 is connected directly to the boiler 12 while the outlet opening 71 is connected directly to the working subchamber 42 through the port 50. The valve body 61 is constantly urged toward the inlet port 70 by a spring 80 connected to an adjustment screw 81 in the housing 60 so that the force of the spring 80 urging the body 61 toward the port 70 can be changed as required. Thus, when the pressure in the subchamber 42 is sufficiently below boiler pressure, it will be seen that the force of the working fluid from the boiler on the lower face 76 of the valve body 61 overcomes the force of the spring 80 on the body 61 and causes the body 61 to move upwardly toward the outlet opening 71 to raise the body 61 from the lower valve seat 66 and allow the working fluid from the boiler to pass through the passage 79 and into the subchamber 42.

It will be seen that a pressure drop is generated in the flow of the working fluid from the boiler through the passage 79. This causes less downward pressure to be exerted on the upper face 78 of the body 61 than on the lower face 76. Frictional drag on the side of the body 61 also produces an upward force on the body 61. As the velocity of the working fluid from the boiler through the passage 79 increases, this pressure differential between the faces 76 and 78 increases along with the frictional drag on the side of the body 61 until the downward force exerted by the spring 80 is overcome and the valve body 61 is forced up against the valve seat 69 to stop the flow of the working fluid from the boiler 12 into the working subchamber 42. It will thus be seen that, by appropriately adjusting the adjusting screw 81, the velocity at which the valve body 61 will be forced up against the valve seat 69 can be controlled. The critical velocity of the working fluid from the boiler 12 through the passage 79 at which the valve body 61 closes against seat 69 is controlled so that the kinetic energy induced into the piston 40 by the working fluid from the boiler 12 at the point of boiler valve closure can be selected.

On the other hand, it will be seen that when the pressure in the working subchamber 42 is raised to the vicinity of the pressure of the working fluid in the boiler on the return compression stroke of the piston 40, the pressure on the upper face 78 of the valve body 61 will be raised to a leval, in combination with the force of the spring 80, to return the valve body 61 to its lower position, close the body 61 against the valve seat 66 and prevent the working fluid in the working subchamber 42 from being forced back into the boiler 12. This action serves to reset the valve $V_1$ so that when the pressure in the working subchamber 42 drops to boiler pressure, the valve $V_1$ can again open to introduce working fluid into the subchamber 42. To ensure that the valve body 61 will be forced back toward the valve seat 66, a push rod 82 may be provided on the upper face 78 of the valve body 61 to project into the working chamber 42 when the valve body 61 is in its uppermost position. Rod 82 is arranged so that the piston 40 will strike the push rod 82 to force the valve body 61 physically downwardly toward the valve seat 66 to reset the boiler valve $V_1$.

Figure 3:
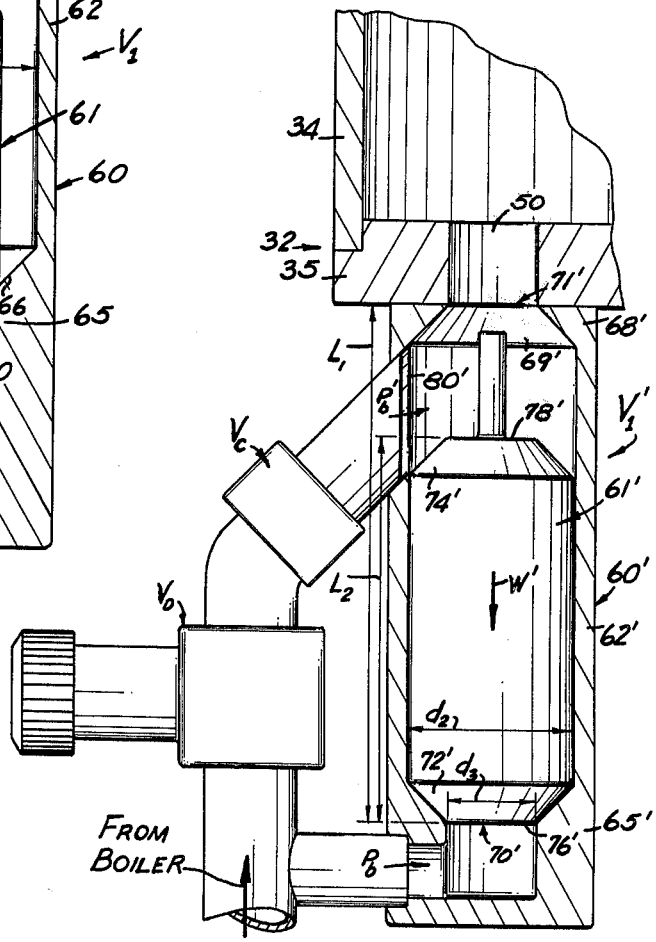
FIG. 3 is an enlarged cross-sectional view of another embodiment of the boiler valve of the invention.

Referring to FIG. 3, a modified construction of the boiler valve is illustrated in detail, and is designated $V_1'$. The valve $V_1'$ differs from the valve $V_1$ in that the valve $V_1'$ is used in conjunction with an adjustable valve $V_D$ which generates a positive pressure drop thereacross in response to the velocity of the fluid flowing therethrough to activate the valve body 61' in the valve $V_1'$ rather than using the pressure drop in the fluid flowing around the valve body 61 in the valve $V_1$. The common characteristic of both of these vavles $V_1'$ and $V_1$ is that they are actuated in response to the velocity of the fluid flowing from the boiler 12 into the working subchamber 42.

The boiler valve $V_1'$ includes a tubular housing 60' which mounts a valve body 61' therein for movement between an upward position blocking the flow of boiler fluid into the subchamber 42 to a lower position which, in conjunction with check valve $V_C$, blocks the flow of working fluid from the subchamber 42 to the boilder. The housing 60' has a cylindrical side wall 62' defining a valve chamber 64' therein of a diameter $d_2$ with a lower inwardly tapering section 65' forming a valve seat 66' on the inside thereof and an upper inwardly tapering section 68' forming a valve seat 69' on the inside thereof. The valve seat 66' defines an inlet opening 70' therethrough of a diameter $d_3$ and the upper valve seat 69' also defines an outlet opening 71' therethrough of the diameter $d_3$.

The valve body 61' is cylindrical with a diameter substantially equal to the diameter $d_2$ so that the valve body 61' is just slidably receivable in the valve chamber 64'. The body 61' has a lower inwardly tapering seating surface 72' adapted to seat on the lower valve seat 66' in sealing relationship therewith when the body moves downwardly in the housing 60' and the upper end of the valve body 61' has an inwardly tapering seating surface 74' adapted to engage the upper valve seat 69' in sealing engagement therewith when the body 61' moves upwardly in the housing 60'. It will be noted that the valve chamber 64' has a length $L_1$ greater than the length $L_2$ between the lower face 76' of the body 61' and the upper face 78' of the body 61'.

It will further be noted that the housing 60' defines an inlet port 80' to the chamber 64' that lies above the valve body 61' when it is in its lowermost position shown in FIG. 3 seated on the lower valve seat 66'. The port 80' is connected to the downstream outlet of the pressure drop valve $V_D$ which has it upstream inlet connected to the outlet of the boiler 12. It will also be noted that the inlet opening 70' below the valve body 61' is connected to the outlet of the boiler 12 upstream of the valve $V_D$. The valve $V_D$ is adjustable and is of the type that generates a pressure drop thereacross that increases with the velocity of the fluid flowing therethrough. Thus, it will be seen that the boiler pressure $P_b$ will be applied to the inlet side of the valve $V_D$ while the pressure $P_b'$ on the outlet side of the valve $V_D$ will be lower than the boiler pressure $P_b$ and will vary according to the velocity of the fluid flowing from the boiler 12 through the valve $V_D$ into the working subchamber 42.

Because the valve body 61' has a prescribed weight W', the valve $V_D$ can be set so that the pressure $P_b$ from the boiler applied to the face 76' of the valve body 61' will be sufficiently greater than the reduced pressure $P_b'$ applied to the upper face 78' of the valve body 61' to cause the valve body 61' to shift upwardly against the upper valve seat 69' and stop the flow of fluid into the working subchamber 42 through the valve $V_1'$ and the inlet port 50. Thus, it will be seen that the net result of the valve $V_1'$ is the same as that of the valve $V_1$. Because the valve body 61' is relatively lightweight, it will require a small pressure drop across the valve $V_D$ to activate the valve $V_1'$. It will be seen that when the downward force exerted on the valve body 61' by the pressure in the working subchamber 42 when the valve body 61' is in its upper position, plus the force generated by the weight W' of the valve body 61', becomes greater than the upward force exerted on the valve body 61' by the pressure at the lower face 76, the valve body 61' will drop to its lowermost position as seen in FIG. 3 to allow the fluid from the boiler 12 to again enter the working subchamber 42 when the pressure in the working subchamber 42 is below the boiler pressure $P_b$. An appropriate check valve $V_C$ may be placed in the line between the inlet port 80' and the boiler 12 to prevent the working fluid in the working subchamber 42 from being forced back into the boiler 12 when the pressure in the subchamber 42 is above boiler pressure $P_b$.

CONDENSER VALVES

Figure 4:
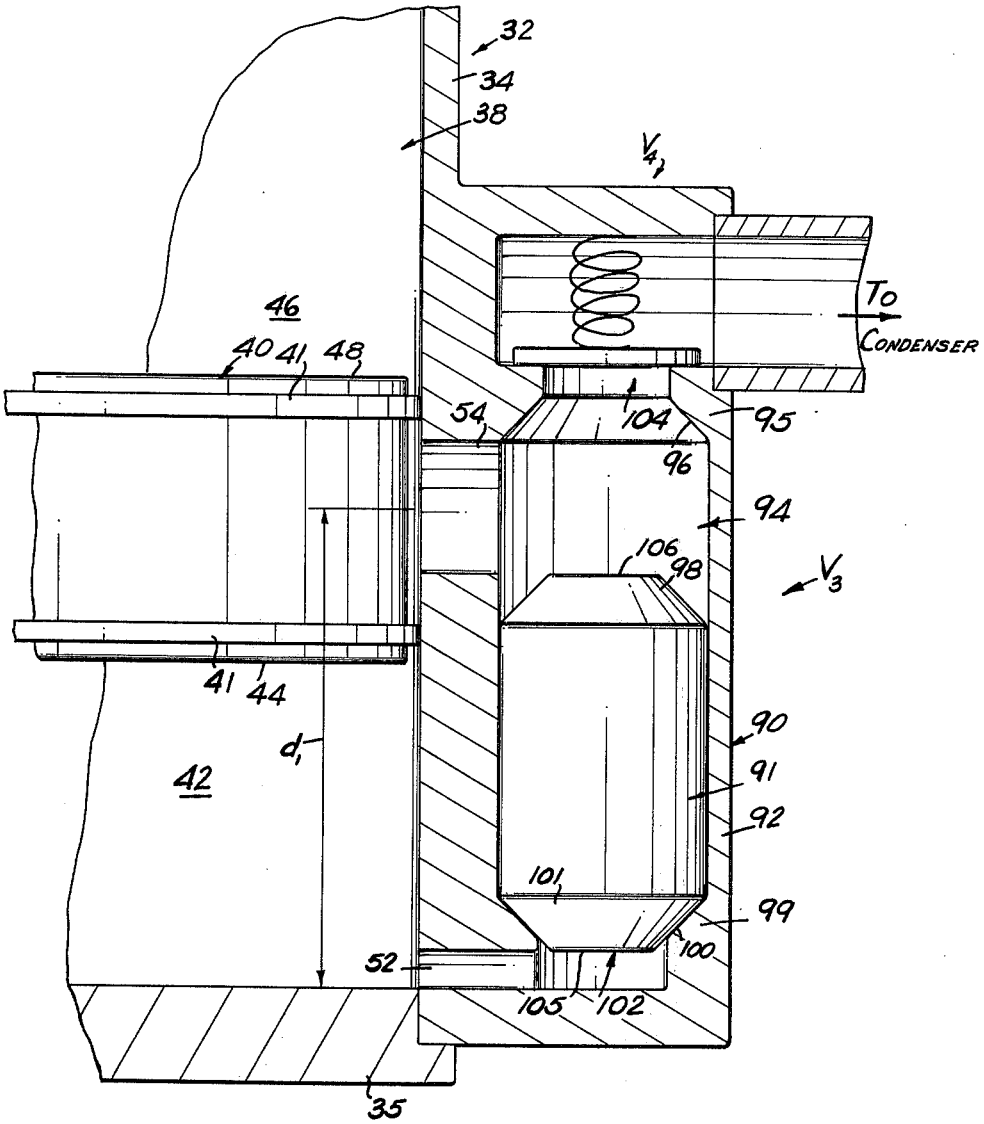
FIG. 4 is an enlarged cross-sectional view of one embodiment of the condenser valves of the invention.

The condenser control valve $V_3$ and the condenser check valve $V_4$ are best seen in FIG. 4 and serve to prevent the discharge of the working fluid from the working subchamber 42 into the condenser 15 during the movement of the free piston assembly 40 toward the back-up subchamber 46 in the up stroke yet allows the discharge of the working fluid from the working subchamber 42 into the inlet 19 of the condenser 15 while the free piston 40 moves toward the working subchamber 42 in the down stroke. The condenser control valve $V_3$ includes a cylindrical housing 90 which slidably mounts a valve body 91 therein. The housing 90 has a cylindrical wall section 92 defining a chamber 94 therein which slidably receives the valve body 91 therein. The upper end of the housing 90 is provided with an inwardly tapering section 95 to form an upper valve seat 96 thereon against which the seating surface 98 on the upper end of the valve body 91 seats as the valve body 91 moves upwardly while the lower end of the housing 90 defines an inwardly tapering section 99 thereon which forms a lower valve seat 100 against which a lower seating surface 101 on the valve body 91 seats as the valve body 91 moves downwardly in the housing 90. It will be seen that the seat 100 defines an opening 102 therethrough in communication with the actuation port 52 in the side wall 34 of the cylinder 32 and the upper valve seat 96 defines an outlet opening 104 therethrough in communication with the condenser outlet port 54. The opening 104 is also connected to inlet 19 of condenser 15 in series with the condenser check valve $V_4$. Valve $V_4$ allows working fluid to flow to the inlet 19 of condenser 15 from the chamber 42 but prevents the flow of the working fluid from the condenser 15 to the chamber 42. The chamber 94 in the housing 90 communicates with the port 54 in the side wall 34 of the cylinder 32 so that when the valve body 91 is in its lower position as seen in FIG. 4, the working subchamber 42 is in communication with the opening 104 through the upper valve seat 96.

The valve body 91 is generally cylindrical with the seating surface 98 at its upper end and the seating surface 101 at its lower end, and has a lower face 105 and an upper face 106. Because the outlet port 54 is located the prescribed distance $d_1$ above the end wall 35 and because the piston 40 blocks port 54 causing the pressure in the working subchamber 42 to rise above condenser pressure as the piston 40 reaches the end of its down stroke and this increase in the pressure of the working fluid in the subchamber 42 causes the pressure exerted on the lower face 105 of the valve body 91 to force the valve body 91 upwardly against the valve seat 96 to prevent the working fluid in the subchamber 42 from entering the condenser 15 when the piston 40 moves from over the port 54 while the piston 40 accelerates upwardly toward the back-up subchamber 46 in the power stroke. The valve body 91 is maintained in its up position while boiler working is introduced into subchamber 42 and until the pressure within the working subchamber 42 again drops below the condenser pressure so that the force exerted on the upper face 106 by the working fluid at condenser pressure exceeds the force exerted on the lower face 105 by the working fluid in chamber 42 to drive the valve body 91 downwardly against the lower valve seat 100. The check valve $V_4$, however, prevents the working fluid from the condenser 15 entering the working subchamber 42 until the pressure in the working subchamber 42 rises back to condenser pressure on the down stroke of piston 40. An external force such as a spring may also be used to aid the piston body 91 in its downward movement.

As the motion of the piston 40 is reversed and moves back down toward the working chamber 42 in the compression stroke, the port 54, which is now in communication with the opening 104, allows the working fluid in the working subchamber 42 to be forced out through the check valve $V_4$ when the pressure in the working subchamber 42 rises to the pressure of the working fluid in the condenser 15. This allows the working fluid in the working subchamber 42 to remain at condenser pressure and the working fluid to be forced from the working subchamber 42 into condenser 15 as the piston continues to move toward the working subchamber 42 until the piston 40 moves over the port 54 to again block the flow of working fluid from the working subchamber 42 through the port 54. This causes the pressure to rise in the working subchamber 42 and this rise in pressure, which is communicated to the lower face 105 of the valve body 91 through the actuation port 52, causes the valve body 91 to be forced back up against the valve seat 96 to prevent the flow of working fluid from the working subchamber 42 until the pressure in the working subchamber 42 has again dropped below the pressure of the working fluid in the condenser 15 during the up stroke.

OPERATION OF THE FIRST EMBODIMENT

It is to be understood that any number of working fluids may be used in this system such as the commercially available refrigerants sold under the trademark "Freon" by E. I. duPont de Nemours Co. The working fluid in the boiler 12 will have some prescribed pressure $P_b$ and some prescribed temperature $T_b$, the condenser 15 will have some prescribed pressure $P_c$ and some prescribed temperature $T_c$, and the evaporator 14 will have some prescribed pressure $P_3$ and some prescribed temperature $T_e$. These pressures and temperatures may vary over the operating range of the system 10, however, it will be noted that, in the absence of friction and heat transfer within the expansion-compression device 11, the system will operate as long as the boiler pressure $P_b$ is greater than the condenser pressure $P_c$. It will further be noted that the pressure in the back-up subchamber must be less than boiler pressure when the free piston 40 is at the limit of its movement toward the working subchamber 42 at the end of the compression stroke and must be greater than the evaporator pressure $P_e$ when the free piston 40 is at the limit of its movement toward the back-up subchamber 46 at the end of the power stroke as will become more apparent.

The operation of the system can best be understood by assuming some set values for the pressures and temperatures involved as might be typical for a system in actual operation. For instance, using refrigerant R-12, a boiler temperature $T_b$ of 150° F, an evaporator temperature $T_e$ of 40° F and a condenser temperature $T_c$ of 95° F, the boiler pressure $P_b$ would be approximately 249 psia, the evaporator pressure $P_e$ would be approximately 52 psia and the condenser pressure $P_c$ would be approximately 123 psia. While it is not necessary that the back-up subchamber 46 be connected to the condenser 15 as long as the pressure within the back-up subchamber 46 is maintained within the parameters set forth above, the system will be described as in direct connection with the inlet to the condenser 15 for sake of simplicity since this pressure is within the parameters set forth, since the connection is convenient, and since this connection produces a sealed system. Further, for sake of simplicity, pressure losses through the various pipes connecting the components of the system and the valves, heat losses and the force of gravity on the piston 40 have been neglected even though these factors may play a role in the practical operation of the system. The initial acceleration of the piston 40 can be calculated by multiplying the force of gravity times the difference between the boiler pressure $P_b$ and the condenser pressure $P_c$ divided by the unit weight of the piston. In the embodiment illustrated, a change in the weight of the piston while the remaining system is not changed would change the volume of working fluid compressed and the length of the stroke.

Figure 5:
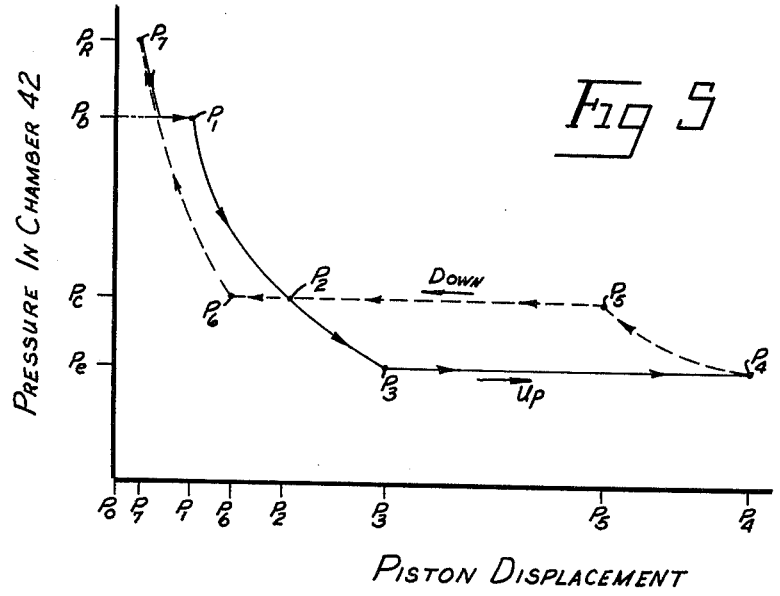
FIG. 5 is a graph illustrating the pressure in the working subchamber of that embodiment of the invention shown in FIG. 1 versus piston displacement.
Figure 6:
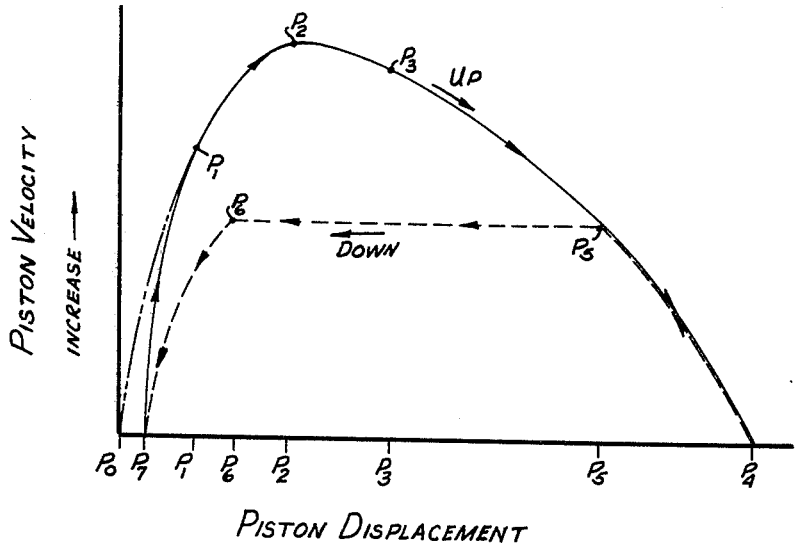
FIG. 6 is a graph illustrating the piston velocity of that embodiment of the invention shown in FIG. 1 versus piston displacement.

Initially, the piston 40 is at rest at the bottom of the chamber 38 at position $P_o$. A start valve $V_s$ as shown in FIG. 1 may be placed between the boiler valve $V_1$ and the outlet 16 to the boiler 12. The start valve $V_S$ should be of the fast acting type to allow the flow of boiler working fluid through the boiler valve $V_1$ to achieve the necessary velocity to operate the valve $V_1$. The operation of the system will also become more apparent upon reference to FIGS. 5 and 6. FIG. 5 is a graph plotting the pressure of the working fluid in subchamber 42 versus piston displacement while FIG. 6 is a graph plotting piston velocity versus piston displacement. In each of these figures the up stroke is shown by a solid line while the down stroke is shown by a dashed line. The movement and velocity of the piston between position $P_o$ and $P_1$ during start up is shown by phantom lines.

When the start valve $V_S$ is opened, the boiler valve $V_1$ will introduce the working fluid from the boiler 12 into the working subchamber 42 at boiler pressure $P_b$. This starts accelerating the piston 40 upwardly from position $P_0$ toward the back-up subchamber 46 in the up stroke since the net force on piston 40 is toward subchamber 46. When the piston 40 has reached a prescribed velocity so that the flow of the working fluid from the boiler 12 through the passage 79 about the valve body 61 reaches the critical velocity, the valve body 61 will be shifted to close against the seat 69 and prevent further access of the working fluid from the boiler 12 to the working subchamber 42. This occurs at position $P_1$. Because the boiler pressure $P_b$ is well above the condenser pressure $P_c$, the piston 40 continues to accelerate under the influence of the expanding working fluid initially from the boiler 12.

By the time the piston 40 reaches the position $P_2$ illustrated in FIG. 1, the pressure of the working fluid in the subchamber 42 will be expanded down to the condenser pressure $P_c$. As seen in FIG. 6, the piston 40 has reached peak velocity and thus peak linear kinetic energy at position $P_2$. At position $P_2$ the pressure in back-up subchamber 46 equals the pressure in working subchamber 42 and no net force is applied to piston 40 by the working fluid. The linear kinetic energy which has been induced into piston 40, however, continues to move piston 40 upwardly past position $P_2$.

The pressure in the working subchamber 42 now starts to drop below the condenser pressure $P_c$ so that the net force on the free piston 40 by the working fluid reverses to a downward force. This causes the free piston 40 to start to decelerate as seen in FIG. 6. When the piston 40 reaches position $P_3$, the pressure of the working fluid in th subchamber 42 has expanded to a pressure slightly less than the evaporator pressure $P_e$. This causes the evaporator check valve $V_2$ to open and maintain the pressure in the working subchamber 42 at evaporator pressure $P_e$ while the linear kinetic energy in the piston 40 continues to move the piston past position $P_3$. The linear kinetic energy in piston 40 continues to move the piston 40 toward the back-up subchamber 46 while drawing working fluid from evaporator 14 into the working subchamber 42 until the linear kinetic energy has been consumed as work of compression. Work of compression as used herein includes both the energy required to raise pressure in a working fluid and the energy required to flow the working fluid under a prescribed pressure. The linear kinetic energy in piston 40 will be transferred back into the working fluid of the system by the time the piston 40 reaches position $P_4$ and the piston stops to complete its up stroke.

When the piston 40 stops at position $P_4$, the pressure $P_c$ of the working fluid in the back-up subchamber 46 is greater than the pressure $P_e$ in the working subchamber 42. This pressure difference generates a net force on piston 40 toward the working subchamber 42 to start accelerating the piston 40 toward subchamber 42 in the down stroke. As soon as the down stroke starts the evaporator check valve $V_2$ closes to trap the working fluid drawn into the working subchamber 42 from evaporator 14 in the subchamber 42. Because the boiler valve $V_1$ is closed and since the condenser check valve $V_4$ prevents the flow of working fluid from condenser 15 into subchamber 42 even though control valve $V_3$ has opened, the continued movement of piston 40 toward the subchamber 42 causes the pressure of the working fluid in subchamber 42 to rise. By the time the piston 40 reaches the position $P_5$ in the compression stroke, the pressure in the working subchamber 42 has risen to the condenser pressure $P_c$ and a predetermined linear kinetic energy has been induced into the piston. Because the valve body 91 in the condenser control valve $V_3$ has already dropped to open the opening 104 when the pressure in the working subchamber 42 was lowered below the condenser pressure $P_c$ in the up stroke, the condenser check valve $V_4$ opens to allow the pressure within the working subchamber 42 to remain at condenser pressure and the working fluid in the working subchamber 42 to be expelled into the inlet 19 of the condenser 15 until the piston 40 reaches the position $P_6$ whereupon the piston 40 covers the outlet port 54. Because the pressure forces on the piston 40 have remained equal on both sides thereof during the movement of the piston 40 between positions $P_5$ and $P_6$, it will be seen that the piston remains at substantially the same velocity and thus the linear kinetic energy at position $P_5$ is still maintained at position $P_6$. As soon as the piston 40 covers the outlet port 54, the pressure within the working subchamber 42 starts to rise above condenser pressure $P_c$ as the linear kinetic energy in the piston 40 continues to move the piston toward the working subchamber 42. This raises the pressure in the working subchamber 42 above condenser pressure $P_c$ and this pressure differential across the piston 40 causes the piston to start to slow down as seen in FIG. 6 until the pressure in the working subchamber 42 has reached a certain rebound pressure $P_r$ when the piston reaches position $P_7$. This rebound pressure $P_r$ is sufficiently high to arrest the movement of the piston 40 so that the piston stops at point $P_7$. The linear kinetic energy of the piston 40 at position $P_6$ is thus converted to potential energy in the working fluid in the working chamber 42 and, after the piston 40 has stopped to complete the down stroke, this rebound pressure $P_r$ causes the piston 40 to rebound toward the back-up subchamber 46 and start the next up stroke. Usually, this rebound pressure $P_r$ will be greater than the boiler pressure $P_b$ so that the valve body 61 in the boiler valve $V_1$ has been driven downwardly away from the seat 69. It will also be noted that when the pressure in the working subchamber 42 has risen above the condenser pressure $P_c$, the force on the bottom face 105 of the valve body 91 in the condenser valve $V_3$ has forced the valve body 91 upwardly against the seat 96 to prevent the flow of working fluid from the working subchamber 42 into the condenser 15 until the pressure in the working subchamber 42 again drops below condenser pressure to allow the valve body 91 to drop back against the seat 100. As soon as the pressure in the working subchamber 42 drops sufficiently below the boiler pressure $P_b$ due to the piston 40 moving toward the back-up subchamber 46, to overcome the downward force of the spring 80 on valve body 61, the body 61 in the valve $V_1$ rises to again introduce working fluid under boiler pressure into the subchamber 42 to again accelerate the piston 40 toward the back-up chamber 46 in the up stroke. Thus, it will be seen that the cycle is repeated.

From the foregoing, it will be seen that the working subchamber 42 is used both for expansion and compression. During the time the piston 40 moves from position $P_o$ or $P_7$ to position $P_3$ in its up stroke, the working subchamber 42 is acting as an expander in its expansion stroke. As the piston 40 moves from position $P_3$ to position $P_4$ in its up stroke, the working subchamber 42 is acting as a compressor in its intake stroke. On the other hand, when the piston 40 moves from position $P_4$ to position $P_6$ in its down stroke, the working subchamber 42 acts to compress and expel both the working fluid received from the evaporator and the working fluid delivered by the boiler. By using a single subchamber as both an expander and compressor, the system has the capability of operating over an infinitely variable ratio between boiler pressure $P_b$ and condenser pressure $P_c$ not found in prior art systems.

Also, by blocking the expulsion of the working fluid from subchamber 42 as the piston 40 moves from position $P_6$ to position $P_7$ in its down stroke, the pressure in the subchamber 42 is raised back to or greater than boiler pressure so that no throttling losses are encountered when the boiler valve $V_1$ opens to introduce working fluid from boiler 12 into the subchamber 42 when subchamber 42 is at boiler pressure. Thus, the requirement of prior art systems that the volume of the subchamber be reduced as close as possible to zero at the end of the compression stroke is eliminated by the system disclosed herein.

SECOND EMBODIMENT

Figure 7:
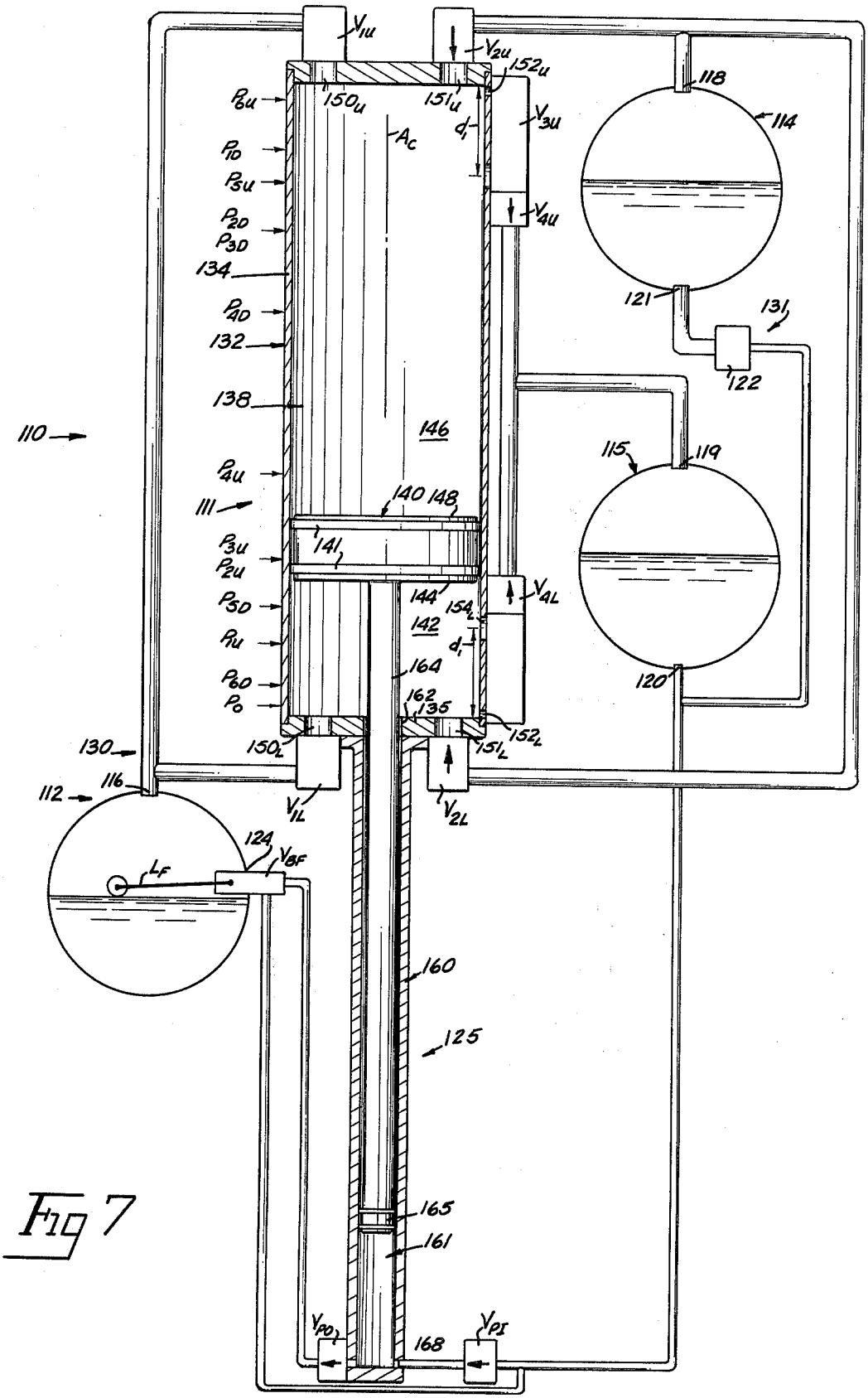
FIG. 7 is a schematic view of a second embodiment of the invention showing the expansion-compression device in cross-section.

Referring to FIG. 7 a second embodiment of the invention is incorporated in a heat pump system 110. The system 110 also includes an expansion-compression device 111, a boiler 112, an evaporator 114 and a condenser 115. The outlet 116 of the boiler 112 is connected to the expansion-compression device 111 to drive same, the outlet 118 of the evaporator 114 is also connected to the expansion-compression device 111 to supply working fluid thereto which is to be compressed and the inlet 119 of the condenser 115 is connected to the expansion-compression device 111 to receive the compressed fluid therefrom. The outlet 120 of the condenser 115 is connected to the inlet 121 of the evaporator 114 through a conventional expansion valve 122 and the outlet 120 of the condenser 115 is also connected to the inlet 124 of the boiler 112 through a liquid pump 125. Thus, it will be seen that the system 110 like system 10, uses a single working fluid and is a dual loop system with the boiler 112, expansion-compression device 111, and condenser 115 forming the power loop while the evaporator 114, expansion-compression device 111 and condenser 115 form the heat pump or refrigeration loop. The power loop has been designated generally 130 in FIG. 7 while the heat pump loop has been designated generally 131 in FIG. 7. The boiler 112 is in a heat exchange relation with a heat source such as a solar energy collector, the evaporator 114 is in a heat exchange relation with a medium which is to be cooled and the condenser 115 is in a heat exchange relation with the medium to be heated as is known in the heat pump art.

The expansion-compression device 111 is a free piston device similar to the device 11 which is driven by high pressure working fluid from the boiler 112 and compresses the system working fluid to discharge same to the condenser 115. The device 111 includes an elongate cylinder 132 with a central axis $A_C$. The cylinder 132 has an annular cylindrical side wall 134 closed at its lower end by end wall 135 and closed at its upper end by an end wall 136. A free piston 140 is slidably carried in the chamber 138 defined by the side wall 134 and the end walls 135 and 136 in sealing engagement with the side wall 134 through sealing rings 141 about the periphery of the free piston 140. It will thus be seen that the free piston 140 divides the chamber 138 into a lower working subchamber 142 between the lower face 144 of the piston 140 and the end wall 135 and an upper working subchamber 146 between the upper face 148 of the piston 140 and the end wall 136. The piston 140 is slidably movable within the cylinder 132 along the central axis $A_C$ so that both the lower working subchamber 142 and the upper working subchamber 146 vary in size as the piston moves linearly along the axis $A_C$. The piston 140 also has a prescribed weight.

The lower end wall 135 defines a lower boiler inlet port $150_L$ therethrough to the lower working subchamber 142 which is connected to the outlet 116 of the boiler 112 through lower boiler valve $V_{1L}$, and a lower evaporator inlet port $151_L$ to lower working subchamber 142 which is connected to the outlet 118 of the evaporator 114 through the lower evaporator check valve $V_{2L}$, that allows fluid to only flow from evaporator 114 into lower working subchamber 142. The side wall 134 defines a lower actuation port $152_L$ therethrough to working subchamber 142 at the juncture of the side wall 134 with the end wall 135 and a lower condenser outlet port $154_L$ therethrough to lower working subchamber 142 spaced a prescribed distance $d_1$ inboard of end wall 135. The port $154_L$ is connected to the inlet 119 of the condenser 115 through a lower condenser control valve $V_{3L}$ and a lower condenser check valve $V_{4L}$ while the lower actuation port $152_L$ is connected to the lower condenser control valve $V_{3L}$ to control same.

The upper end wall 136 defines an upper boiler inlet port $150_U$ therethrough which is connected to the outlet 116 of the boiler 112 through boiler valve $V_{1U}$ in parallel with port $150_L$ and its valve $V_{1L}$. Wall 136 also defines an upper evaporator inlet port $151_U$ which is connected to the outlet 118 of the evaporator 114 thorugh the upper evaporator check valve $V_{2U}$ in parallel with port $151_L$ and its valve $V_{2L}$ so that valve $V_{2U}$ allows fluid to only flow from evaporator 114 into the upper working subchamber 146. The side wall 134 also defines an upper actuation port $152_U$ therethrough to subchamber 146 at the juncture of the side wall 134 with the upper end wall 136 and an upper condenser outlet port $154_U$ therethrough to subchamber 146 spaced a prescribed distance $d_1$ inboard of the end wall 136. The port $154_U$ is connected to the inlet 119 of the condenser 115 through an upper condenser control valve $V_{3U}$ and an upper condenser check valve $V_{4U}$ in parallel with the lower port $154_L$ and its associated valves $V_{3L}$ and $V_{4L}$. The upper actuation port $152_U$ is connected to the upper condenser control valve $V_{3U}$ to control same.

The valves $V_{1L}$–$V_{4L}$ and $V_{1U}$–$V_{4U}$ control the operation of the system 110. Valves $V_{1L}$ and $V_{1U}$ have similar constructions and functions to valve $V_1$ in the system 10 with valve $V_{1L}$ serving to power the piston 140 up toward the upper working subchamber 146 and the valve $V_{1U}$ serving to drive the piston 140 down towrrd the lower subchamber 142. The construction and function of the upper and lower evaporator check valves $V_{2U}$ and $V_{2L}$ are the same as that of evaporator check valve $V_2$ of system 10. The upper and lower condenser control valves $V_{3U}$ and $V_{3L}$ have similar constructions and functions to the condenser control valve $V_3$ of the system 10. The construction and function of the upper and lower condenser check valves $V_{4U}$ and $V_{4L}$ are the same as that of condenser check valve $V_4$ for system 10. It will thus be seen that the expansion-compression device 111 of system 110 is a double acting unit whereas the expansion-compression device 11 of system 10 is a single acting unit. As the piston 140 is driven upwardly toward the upper working subchamber 146, the subchamber 146 is in its compression cycle while the lower subchamber 142 is in its expansion cycle. On the other hand, when the piston 140 moves toward the lower working subchamber 142, the subchamber 142 is in its compression cycle while the upper working subchamber 146 is in its expansion cycle.

The valve $V_{1L}$ would have the same configuration as the valve $V_1$ except that the fluid velocity at which it closes may need to be adjusted to compensate for the different pressure acting on the opposing surface of the piston 140. The valve $V_{1U}$ would also have the same construction except that it would be adjusted differently to compensate for the valve body in the valve $V_{1U}$ moving oppositely to the valve body in the valve $V_{1L}$ and thus slightly change the setting to compensate for the weight of the valve body. The lower condenser control valve $V_{3L}$ would have the same construction as the condenser control valve $V_3$. The upper condenser control valve $V_{3U}$ would also be similar to valve $V_3$ and would operate under similar conditions.

While the same type of liquid pump may be used in the power loop of the system 110 as used in the system 10, the liquid pump 125 illustrated for system 110 is attached to and driven by the expansion-compression device 111. This type liquid pump is advantageous in that no external seals are required which could cause loss of refrigerant and the energy required to drive the pump is supplied by the boiler 112 through the expansion-compression device thereby eliminating the need for an external power source.

As seen in FIG. 7, the pump 125 includes a cylinder 160 attached to the lower end wall 135 defining a pump chamber 161 therein. The upper end of chamber 161 communicates with the lower working chamber 142 through piston opening 162 in the end wall 135. The lower end of chamber 161 is closed. A piston 164 is attached to the lower side of free piston 140 and extends into the pump chamber 161 through opening 162 in end wall 135. The lower end of piston 164 has an appropriate seal 165 thereon which is slidably carried by cylinder 160 in chamber 161 in a sealing relationship therewith.

The remote or lower end of pump chamber 161 is connected to the outlet 120 of condenser 115 through a pump inlet check valve $V_{PI}$ and pipe 168 so that fluid can only flow from the condenser 115 into pump chamber 161. The lower end of pump chamber 161 is also connected to the inlet of the boiler 112 through a pump outlet check valve $V_{PO}$ that only allows fluid to flow from the pump chamber 161 into boiler 112, and a boiler inlet float valve $V_{BF}$ in series with valve $V_{PO}$.

As the pump piston 164 is moved upward during the up stroke of free piston 140 in the expansion-compression device 111, the pressure in pump chamber 161 is reduced to a level which causes pump outlet check valve $V_{PO}$ to close and pump inlet check valve $V_{PI}$ to open. The working fluid from the condenser 115 fills pump chamber 161 as the piston 164 continues to move in its up stroke. As the pump piston 164 begins its down stroke with free piston 140, the pressure in pump chamber 161 increases rapidly causing the pump inlet check valve $V_{PI}$ to close and pump outlet check valve $V_{PO}$ to open when this pressure exceeds the boiler pressure. As the pump piston 164 moves down, it continues to expel the working fluid in pump chamber 161 therefrom to float valve $V_{BF}$ during the remainder of the down stroke.

The boiler float valve $V_{BF}$ is a conventional three-way valve whose operation is controlled by the vertical movement of a float lever $L_F$. When the liquid level of the working fluid in boiler 112 is low, the valve $V_{BF}$ connects the input from pump chamber 161 directly into the boiler 112. When the liquid level of the working fluid in boiler 112 rises to a predetermined level, the float valve $V_{BF}$ is shifted by the float lever $L_F$ to transfer the flow of working fluid received from the pump chamber 161 from the boiler 112 back to the inlet side of chamber 161 between condenser outlet 120 and check valve $V_{PI}$.

The diameter of pump piston 164 and the length of its stroke determines the capacity of the pump 125 for each stroke. This pump piston diameter is chosen to provide sufficient capacity to supply the boiler 112 while operating at its maximum rate. Under lower operating conditions, excess working fluid from chamber 161 is bypassed around the boiler and back through the liquid pump. The energy required to pump the liquid is also reduced as the fluid is being bypassed since the liquid pump needs only to provide enough pressure to overcome the frictional losses in the bypass loop.

While the pump 125 is illustrated on only the lower end of the expansion-compression device 111, it could be used on both ends to equalize the forces required to drive same both during the up stroke and the down stroke of the free piston 140.

OPERATION OF THE SECOND EMBODIMENT

Like the first embodiment of the system, the second embodiment would use similar types of working fluid with the boiler 112 having some prescribed pressure $P_b$ and some prescribed temperature $T_b$, the condenser 115 having some prescribed pressure $P_c$ and some prescribed temperature $T_c$, and the evaporator 114 having some prescribed pressure $P_e$ and some prescribed temperature $T_e$. The pressure $P_b$ is greater than the pressure $P_c$ which is greater than the pressure $P_e$. The operation of the system can best be understood by assuming some set values for pressures and temperatures as might be typical for a system in actual operation and for purposes of reference, the same pressures and temperatures as used with the first embodiment of this system will be assumed. For sake of simplicity the friction losses and the weight of the piston 140 is ignored in the operation description although these items would have some effect on system operation. Also, the energy required to drive the liquid pump 125 is ignored, however, it will be understood that the boiler valves $V_{1L}$ and $V_{1U}$ would be adjusted to appropriately supply this energy. Initially, the piston 140 will be at rest at the bottom of chamber 138 at position $P_o$ because of the weight of the piston. A start valve (not shown) similar to that already described for the first embodiment of the system will be used to start the operation of the system by quickly connecting the boiler pressure $P_b$ to the lower boiler valve $V_{1L}$. The operation of the system will be best understood by reference to FIGS. 8–10 with FIG. 8 being a graph plotting the pressure of the working fluid in the lower working subchamber 142 versus piston displacement, with FIG. 9 being a graph plotting the pressure of the working fluid in the upper working subchamber 146 versus piston displacement, and with FIG. 10 being a graph plotting piston velocity versus piston displacement. In each of these figures, the up stroke of the piston is shown by solid lines while the down stroke of the piston is shown by dashed lines.

When the start valve (not shown) is opened, the lower boiler valve $V_{1L}$ will introduce the working fluid from the boiler 112 into the lower working subchamber 142 at boiler pressure $P_b$. This starts accelerating the piston 140 upwardly in the up stroke from the position $P_o$ toward the upper working subchamber 146 since the net force on the piston 140 is toward the subchamber 146. When the piston 140 has reached a prescribed upward velocity so that the flow of working fluid from the boiler 112 through the lower boiler valve $V_{1L}$ reaches the critical velocity, the valve $V_{1L}$ will close to stop the flow of working fluid from the boiler 112 to the lower working subchamber 142. This occurs at position $P_{1U}$. Because the boiler pressure $P_b$ is well above the pressure of the working fluid in the upper working subchamber 146, the piston 140 continues to accelerate upwardly under the influence of the expanding working fluid in lower working subchamber 142. At this time, the pressure of the working fluid in the upper working subchamber 146 is normally somewhere between evaporator pressure $P_e$ and condenser pressure $P_c$ or at condenser pressure $P_c$ since the upper evaporator check valve $V_{2U}$ is closed.

Figure 10:
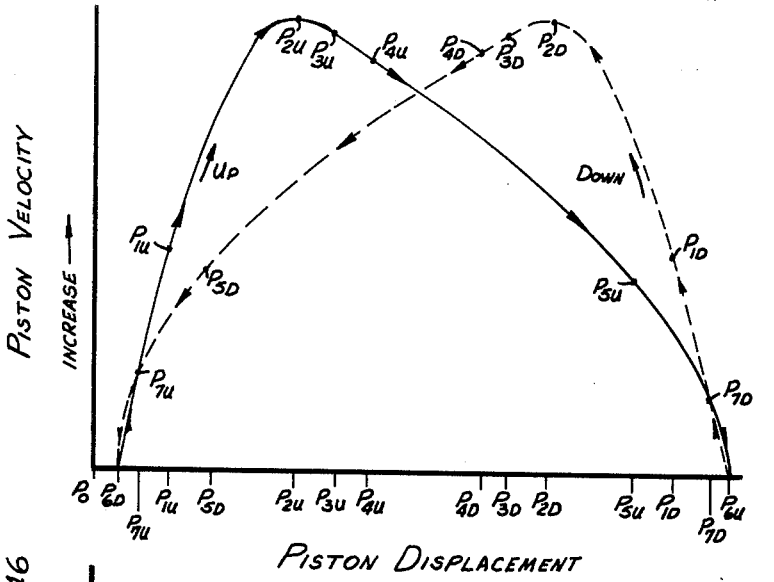
FIG. 10 is a graph illustrating the piston velocity of that embodiment of the invention shown in FIG. 7 versus piston displacement; and, FIG. 11 is a schematic view of a third embodiment of the invention showing the expansion-compression device in cross-section.

By the time the piston 140 reaches the position $P_{2U}$ in the up stroke shown in FIGS. 7–10 the pressure of the working fluid in the lower subchamber 142 will have expanded down to the pressure of the working fluid in the upper working subchamber 146. Because the working fluid in the upper working subchamber 146 is being compressed up to condenser pressure $P_c$, position $P_{2U}$ will usually be reached either while the pressure of the working fluid in the upper working subchamber 146 is somewhere between evaporator pressure $P_e$ and condenser pressure $P_c$ or while the pressure in the upper working subchamber 146 is at condenser pressure $P_c$. As seen in FIG. 10, the piston 140 has now reached peak velocity in its up stroke and thus peak linear kinetic energy at position $P_{2U}$. The linear kinetic energy which has been induced into piston 140 continues to move the piston 140 upwardly past position $P_{2U}$ so that the pressure in the lower working subchamber 142 now starts to drop below the pressure of the working fluid in the upper subchamber 146 and the net force on the free piston 140 by the system working fluid reverses from an upward net force to a downward net force. This causes the free piston 140 to start to decelerate as seen in FIG. 10 in its up stroke.

As the free piston 140 moves upwardly, a position $P_{3U}$ will be reached where the pressure in the working fluid in the upper working subchamber 146 will reach condenser pressure $P_c$. At this time the upper condenser control valve $V_{3U}$ will already be open and the upper condenser check valve $V_{4U}$ will open to allow the working fluid in the upper working subchamber 146 to remain at condenser pressure and to be discharged into the condenser 115 as the piston 140 continues its up stroke.

As the induced linear kinetic energy in the free piston 140 continues to move the free piston 140 upwardly past position $P_{2U}$, the working fluid in the lower working subchamber 142 will continue to expand until a position $P_{4U}$ is reached where the pressure of the working fluid in the lower subchamber 142 has expanded to a pressure slightly less than the evaporator pressure $P_e$ so that the lower evaporator check $V_{2L}$ opens. Thus, as the linear kinetic energy in the piston 140 continues to move the piston 140 upwardly past the position $P_{4U}$, the lower evaporator check valve $V_{2L}$ keeps the lower working subchamber 142 in communication with the outlet of the evaporator 114 so that working fluid from the evaporator 114 is drawn into the lower working subchamber 142 and the pressure of the working fluid in the lower working subchamber 142 remains at evaporator pressure for the rest of the stroke.

As the piston 140 continues to move upwardly under the influence of the induced linear kinetic energy, the piston 140 reaches a position $P_{5U}$ where the piston 140 covers the upper condenser outlet port $154_U$ to block the flow of the working fluid from the upper working subchamber 146 into the condenser 115. With the unconverted linear kinetic energy still driving piston 140 upwardly past position $P_{5U}$, the pressure of the working fluid in the upper working subchamber 146 starts to rise above condenser pressure $P_c$, while the pressure in the lower working subchamber 142 remains at evaporator pressure $P_e$. This raises the pressure in the upper working subchamber 146 above condenser pressure $P_c$ and this pressure differential across the piston 140 causes the piston to stop its upward movement as seen in FIG. 10 when the pressure in the upper working subchamber 146 has reached a certain rebound pressure $P_{RU}$ at position $P_{6U}$. The linear kinetic energy of the piston 140 remaining at position $P_{5U}$ is thus converted to potential energy in the entrapped working fluid in the upper working subchamber 146. When the piston 140 stops at position $P_{6U}$ to complete the stroke, the subchamber 146 is at rebound pressure $P_{RU}$ while the lower working subchamber 142 is at evaporator pressure $P_e$ exerting a net downward force on the piston 140 to cause the piston 140 to rebound downwardly toward the lower subchamber 142 and start the down stroke. Usually, this rebound pressure $P_{RU}$ will be greater than the boiler pressure $P_b$ so that this greater pressure will set the upper boiler valve $V_{1U}$ for operation. It will also be noted that, when the pressure in the upper working subchamber 146 has risen above the condenser pressure $P_c$, the actuation force on the upper condenser valve $V_{3U}$ has closed the valve to prevent the flow of working fluid from the working subchamber 146 into the condenser 115 until the pressure in the working subchamber 146 again drops below condenser pressure to re-open the valve.

As the piston 140 rebounds downwardly to start the down stroke, the pressure in the upper working subchamber 146 starts to drop below the boiler pressure $P_b$ due to the movement of the piston 140 toward the lower working subchamber 142. This causes the upper boiler valve $V_{1U}$ to open at $P_{7D}$ and introduce working fluid under boiler pressure $P_b$ into the upper working subchamber 146 to accelerate the piston 140 toward the lower working subchamber 142 in the down stroke. When the piston 140 has reached a prescribed downward velocity so that the flow of working fluid from the boiler 112 through the upper boiler valve $V_{1U}$ reaches the critical velocity, the valve $V_{1U}$ will close to stop the flow of working fluid from the boiler 112 to the upper working subchamber 146. This occurs at position $P_{1D}$. Because the boiler pressure $P_b$ is well above the pressure of the working fluid in the lower working subchamber 142, the piston 140 continues to accelerate downwardly under the influence of the expanding working fluid in upper working subchamber 146. At this time, the pressure of the working fluid in the lower working subchamber 142 is normally somewhere between evaporator pressure $P_e$ and condenser pressure $P_c$ or at condenser pressure $P_c$ since the lower evaporator check valve $V_{2L}$ is closed.

By the time the piston 140 reaches the position $P_{2D}$ in the down stroke shown in FIGS. 7–10, the pressure of the working fluid in the upper subchamber 146 will have expanded down to the pressure of the working fluid in the lower working subchamber 142. Because the working fluid in the lower subchamber 142 is being compressed up to condenser pressure $P_c$ position $P_{2D}$ will usually be reached either while the pressure of the working fluid in the lower working subchamber 142 is somewhere between evaporator pressure $P_e$ and condenser pressure $P_c$ or while the pressure in the lower working subchamber 142 is at condenser pressure $P_c$. As seen in FIG. 10, the piston 140 has now reached peak velocity in its down stroke and thus peak linear kinetic energy at position $P_{2D}$. The linear kinetic energy which has been induced into piston 140 continues to move the piston 140 downwardly past position $P_{2D}$ so that the pressure in the upper working subchamber 146 now starts to drop below the pressure of the working fluid in the lower subchamber 142 and the net force on the free piston 140 by the system working fluid reverses from a downward net force to an upward net force. This causes the free piston 140 to start to decelerate as seen in FIG. 10 in its down stroke.

As the free piston 140 moves downwardly, a position $P_{3D}$ will be reached where the pressure in the working fluid in the lower working subchamber 142 will reach condenser pressure $P_c$. At this time the lower condenser control valve $V_{3L}$ will already be open and the lower condenser check valve $V_{4L}$ will open to allow the working fluid in the lower working subchamber 142 to remain at condenser pressure and to be discharged into the condenser 115 as the piston 140 continues its down stroke.

As the induced linear kinetic energy in the free piston 140 continues to move the free piston 140 downwardly past position $P_{2D}$, the working fluid in the upper working subchamber 146 will continue to expand until a position $P_{4D}$ is reached where the pressure of the working fluid in the upper working subchamber 146 has expanded to a pressure slightly less than the evaporator pressure $P_e$ so that the upper evaporator check valve $V_{2U}$ opens. Thus, as the linear kinetic energy in the piston 140 continues to move the piston 140 downwardly past the position $P_{4D}$, the upper evaporator check valve $V_{2U}$ keeps the upper working subchamber 146 in communication with the outlet of the evaportor 114 so that working fluid from the evaporator 114 is drawn into the upper working subchamber 146 and the pressure of the working fluid in the upper working subchamber 146 remains at evaporator pressure for the rest of the down stroke.

As the piston 140 continues to move downwardly under the influence of the induced linear kinetic energy, the piston 140 reaches the position $P_{5D}$ where the piston 140 covers the lower condenser outlet port $154_L$ to block the flow of the working fluid from the lower working subchamber 142 into the condenser 115. With the unconverted linear kinetic energy still driving piston 140 downwardly past position $P_{5D}$, the pressure of the working fluid in the lower working subchamber 142 starts to rise above condenser pressure $P_c$, while the pressure in the upper working subchamber 146 remains at evaporator pressure $P_e$. This raises the pressure in the lower working subchamber 142 above condenser pressure $P_c$ and this pressure differential across the piston 140 causes the piston to stop its downward movement as seen in FIG. 10 when the pressure in the lower working subchamber 142 has reached a certain rebound pressure $P_{RD}$ at position $P_{6D}$. The linear kinetic energy of the piston 140 remaining at position $P_{5D}$ is thus converted to potential energy in the entrapped working fluid in the lower working subchamber 142 when the piston 140 stops at position $P_{6D}$ to complete the down stroke, the subchamber 142 is at rebound pressure $P_{RD}$ while the upper working subchamber 146 is at evaporator pressure $P_e$ to exert a net upward force on the piston 140 to cause the piston 140 to rebound upwardly toward the upper working subchamber 146 and start the next up stroke. Usually, this rebound pressure $P_{RD}$ will be greater than the boiler pressure $P_b$ so that this greater pressure will set the lower boiler valve $V_{1L}$ for operation. It will also be noted that, when the pressure in the lower working subchamber 142 has risen above the condenser pressure $P_c$, the actuation force on the lower condenser valve $V_{3L}$ has closed the valve to prevent the flow of working fluid from the lower working subchamber 142 into the condenser 115 until the pressure in the lower working subchamber 142 again drops below condenser pressure to re-open the valve.

As the piston 140 rebounds upwardly to start the next upstroke the pressure in the lower working subchamber 142 starts to drop below the boiler pressure $P_b$ due to the movement of the piston 140 toward the upper working subchamber 146. This causes the lower boiler valve $V_{1L}$ to open at $P_{7U}$ and introduce working fluid under boiler pressure $P_b$ into the lower working subchamber 142 to accelerate the piston 140 toward the upper working subchamber 146 in the up stroke. The cycle then continues to repeat with the working fluid from the evaporator 114 being drawn into the lowe working subchamber 142 on each up stroke and drawn into the upper working subchamber 146 on each down stroke. Working fluid will be compressed and forced into the condenser 115 from the upper working subchamber 146 on each upstroke and from the lower working subchamber 142 on each down stroke.

Each of the working subchambers 142 and 146 is used both for compression and expansion. Subchamber 142 acts as an expander in its expansion stroke during the first part of the up stroke of piston 140 and then acts as a compressor during its intake stroke during the rest of the up stroke of piston 140. At the same time, the subchamber 146 acts to compress and expel both the working fluid received from the evaporator and the working fluid delivered by the boiler. During the down stroke of piston 140, the working subchamber 142 acts to compress and expel both the working fluid received from the evaporator and the working fluid delivered by the boiler. At the same time, the working subchamber 146 acts as an expander in its expansion stroke during the first part of the down stroke of piston 140 and then acting as a compressor in its intake stroke for the rest of the down stroke of piston 140.

THIRD EMBODIMENT

Figure 11:
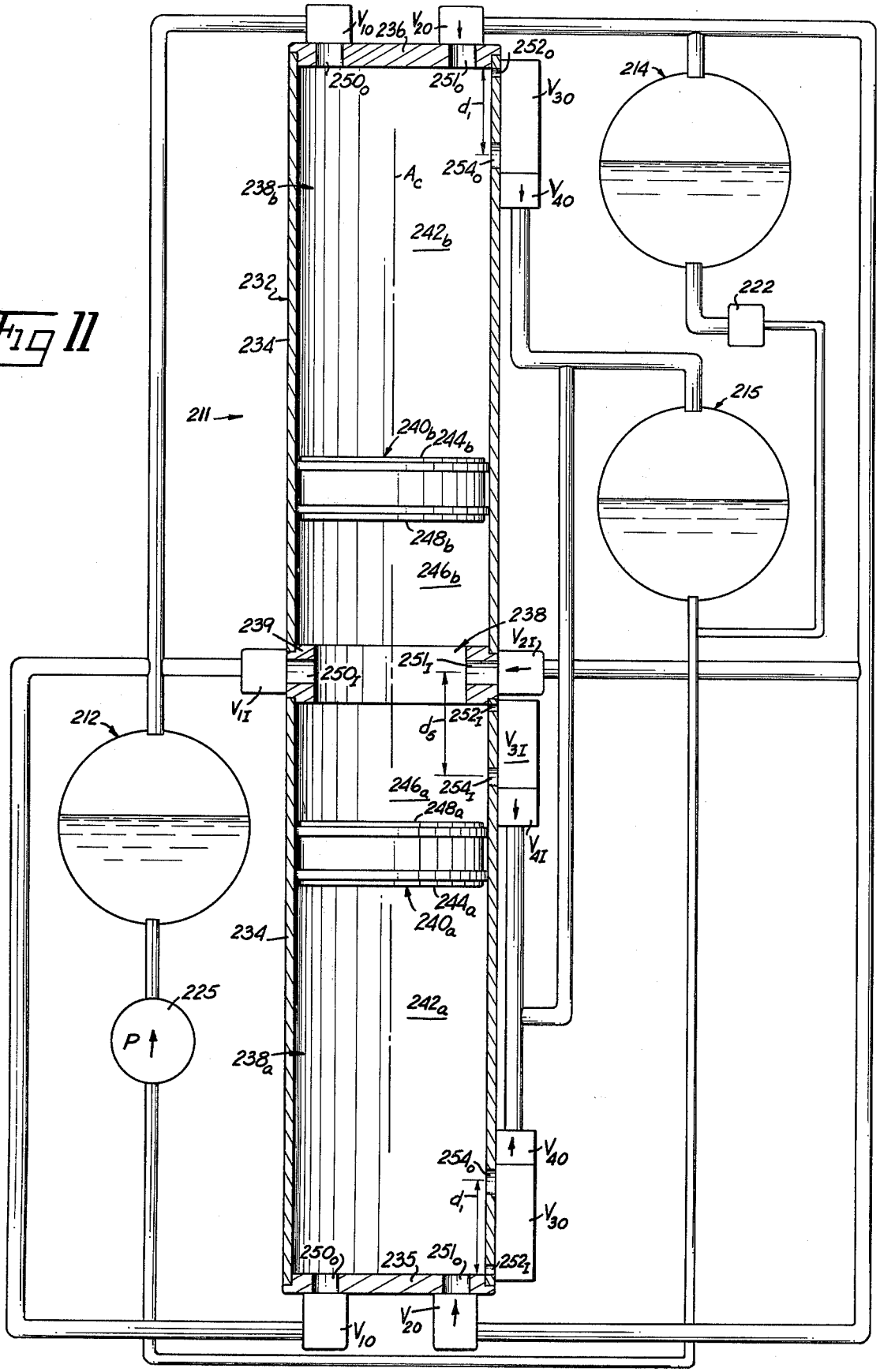

Referring to FIG. 11 a third embodiment of the invention is incorporated in a heat pump system 210. The system 210 also includes an expansion-compression device 211, a boiler 212, an evaporator 214 and a condenser 215. The outlet of the boiler 212, an evaporator 214 and a condenser 215. The outlet of the boiler 212 is connected to the expansion-compression device 211 to drive same, the outlet of the evaporator 214 is also connected to the expansion-compression device 211 to supply working fluid thereto which is to be compressed and the inlet of the condenser 215 is connected to the expansion-compression device 211 to receive the compressed fluid therefrom. The outlet of the condenser 215 is connected to the inlet of the evaporator 214 through a conventional expansion valve 222 and the outlet of the condenser 215 is also connected to the inlet of the boiler 212 through a liquid pump 225. Thus, it will be seen that the system 210 like system 110, uses a single working fluid and is a dual loop system with the boiler 212, expansion-compression device 211, and condenser 215 forming the power loop while the evaporator 214, expansion-compression device 211 and condenser 215 form the heat pump or refrigeration loop. The boiler 212 is in a heat exchange relation with a heat source such as a solar energy collector, the evaporator 214 is in a heat exchange relation with a medium which is to be cooled and the condenser 215 is in a heat exchange relation with the medium to be heated as is known in the heat pump art.

The expansion-compression device 211 is a free piston device which is driven by high pressure working fluid from the boiler 212 and compresses the system working fluid to discharge same to the condenser 215, however, the device 211 differs from the device 111 in that the device 211 houses two free pistons therein rather than the one in the device 111. This causes the resultant reaction forces on the device 211 to be equalized.

The device 211 includes an elongate cylinder 232 with a central axis $A_C$. The cylinder 232 has an annular cylindrical side wall 234 closed at its lower end by end wall 235 and closed at its upper end by an end wall 236 to define a working chamber 238 therein. An annular abuttment shoulder 239 is provided around the inside of side wall 234 midway its length. The shoulder 239 separates working chamber 238 into chamber portion $238_a$ between shoulder 239 and end wall 235, and chamber portion $238_b$ between shoulder 239 and end wall 236, however, the chamber portions $238_a$ and $238_b$ communicate with each other via the opening through shoulder 239.

One free piston $240_a$ is slidably mounted in the chamber portion $238_a$ in sealing relation with side wall 234 while another free piston $240_b$ is slidably mounted in the chamber portion $238_b$ in sealing relation with side wall 234. It will thus be seen that the free piston $240_a$ divides the chamber portion $238_a$ into an outboard working subchamber $242_a$ between the outboard face $244_a$ of the piston $240_a$ and the end wall 235 and an inboard working subchamber $246_a$ between the inboard face $248_a$ of the piston $240_a$ and the shoulder 239. Similarly the other free piston $240_b$ divides the chamber portion $238_b$ into an outboard working subchamber $242_b$ between the outboard face $244_b$ of the piston $240_b$ and the end wall 236 and an inboard working subchamber $246_b$ between the inboard face $248_b$ of the piston $240_b$ and the shoulder 239. Both pistons $240_a$ and $240_b$ are slidably movable along the axis $A_C$ but are not connected so that both pistons $240_a$ and $240_b$ may move simultaneously outwardly from shoulder 239 in their outboard strokes and move simultaneously inwardly toward shoulder 239 in their inboard strokes as will become more apparent.

The end walls 235 and 236 each define an outboard boiler inlet port $250_o$ therethrough to the respective outboard working subchambers $242_a$ and $242_b$. Each port $250_o$ is connected to the outlet of the boiler 212 through an outboard boilder valve $V_{10}$. The end walls 235 and 236 each also define an outboard evaporator inlet port $251_o$ to the respective outboard working subchambers $242_a$ and $242_b$. Each port $251_o$ is connected to the outlet of the evaporator 214 through an outboard evaporator check valve $V_{20}$ so that fluid can only flow from evaporator 214 into the outboard working subchambers $242_a$ and $242_b$. The side wall 234 also defines an outboard condenser outlet port $254_o$ therethrough a prescribed distance $d_1$ inboard of each end walls 235 and 236. Each outboard condenser outlet port $254_o$ is connected to the inlet of the condenser 215 through an outboard condenser control valve $V_{30}$ and an outboard condenser check valve $V_{40}$ while each outboard actuation port $252_o$ is connected to the associated condenser control valve $V_{30}$ to control same.

A common inboard boiler inlet port $250_I$ is defined through side wall 234 and shoulder 239 to both inboard working subchambers $246_a$ and $246_b$. The port $250_I$ is connected to the outlet of boiler 212 through the common inboard boiler inlet valve $V_{1I}$A common inboard evaporator inlet port $251_I$ is also defined through side wall 234 and shoulder 239 to both inboard working subchambers $246_a$ and $246_b$. The port $251_I$ is connected to the outlet of the evaporator 214 through common inboard evaporator inlet check valve $V_{21}$ that allows working fluid to only flow from evaporator 214 into subchambers $246_a$ and $246_b$. A common inboard condenser outlet port $254_I$ is defined through side wall 234 outboard of the mid point of shoulder $239_a$ prescribed distance $d_5$. While the port $254_I$ is illustrated directly to the inboard subchamber $246_a$, it can just as well be directly to subchamber $246_b$ since subchambers $246_a$ and $246_b$ are in communication with each other through the opening through shoulder 239. The inboard condenser outlet port $254_I$ is connected to the inlet of the condenser 215 through an inboard condenser control valve $V_{31}$ and an inboard condenser check valve $V_{41}$ while the inboard actuation port $252_I$ is connected to the inboard condenser control valve $V_{31}$ to control same.

OPERATION OF THE THIRD EMBODIMENT

The third embodiment of the invention incorporated in the heat pump system 210 operates very similar to the heat pump system 110 except that two free pistons are involved rather than one. Thus, if one looks at the free piston $240_a$ and its associated chamber portion $238_a$ or at the free piston $240_b$ and its associated chamber portion $238_b$, it will be seen that a very close correspondence exists between each free piston $240_a$ or $240_b$ and the free piston 140 of the second embodiment of the invention. If one equates the inboard stroke of each of the pistons $240_a$ and $240_b$ with the up stroke of the piston 140 and equates the outboard stroke of each of the pistons $240_a$ and $240_b$ with the down stroke of the free piston 140, the pressure and velocity graphs shown in FIGS. 8–10 can be applied directly to each of the pistons $240_a$ and $240_b$.

It will also be noted that the outboard boiler inlet valves $V_{10}$ correspond to the lower boiler inlet valve $V_{1L}$ for the second embodiment of the invention. The inboard boiler inlet valve $V_{1I}$ corresponds to the upper inlet valve $V_{1U}$ of the second embodiment of the invention except that the boiler inlet valve $V_{1I}$ has twice the capacity of the boiler inlet valve $V_{1U}$. Likewise, the outboard evaporator inlet check valves $V_{20}$ correspond to the lower evaporator inlet check valve $V_{2L}$ of the second embodiment of the invention, while the common inboard evaporator inlet check valve $V_{2I}$ corresponds to the upper evaporator inlet check valve $V_{2U}$ of the second embodiment of the invention except that the check valve $V_{2I}$ has twice the capacity of the upper evaporator inlet check valve $V_{2U}$ of the second embodiment of the invention. The outboard condenser outlet valves $V_{30}$ and the outboard condenser check valves $V_{40}$ correspond to the lower condenser control valve $V_{3L}$ and the lower condenser check valve $V_{4L}$ of the second embodiment of the invention while the common inboard condenser control valve $V_{3I}$ and the common inboard condenser check valve $V_{4I}$ correspond to the upper condenser control valve $V_{3U}$ and the upper condenser check valve $V_{4U}$ of the second embodiment of the invention except that these valves of the third embodiment of the invention have twice the capacity of the second embodiment of the invention. Thus, it will be seen that the system 210 simultaneously moves both of the free pistons $240_a$ and $240_b$ inwardly toward the abuttment shoudler 239 in the inboard strokes and simultaneously moves both free pistons $240_a$ and $240_b$ outwardly toward the respective end wall in the outboard strokes of these pistons.

Figure 8:
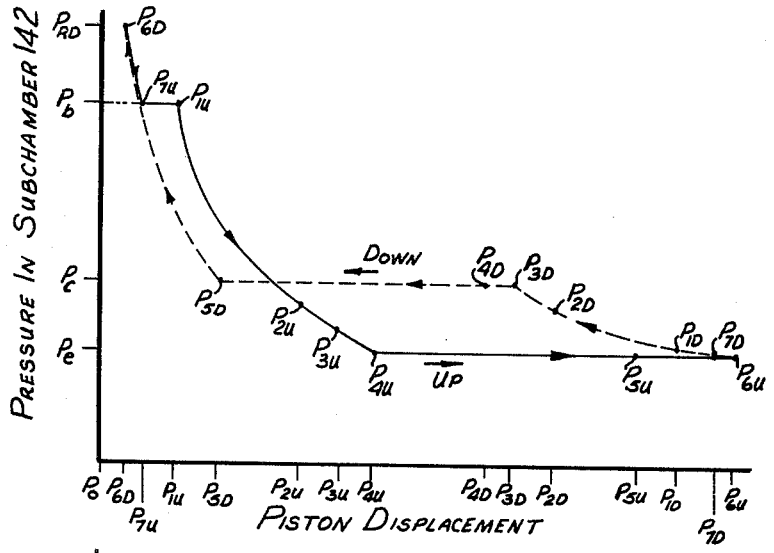
FIG. 8 is a graph illustrating the pressure in the lower working subchamber of that embodiment of the invention shown in FIG. 7 versus piston displacement.
Figure 9:
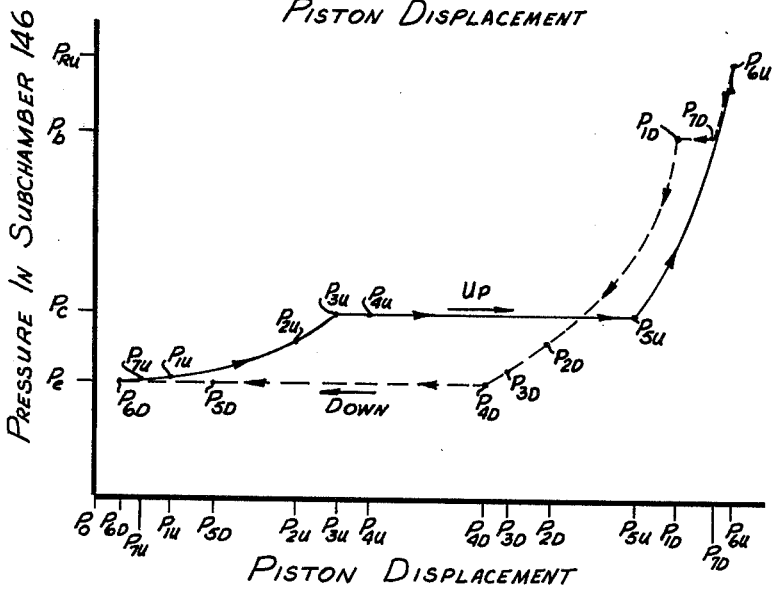
FIG. 9 is a graph illustrating the pressure in the upper working subchamber of that embodiment of the invention shon in FIG. 7 versus piston displacement.

Special consideration should be given to the startup of the system 210 since both free pistons $240_a$ and $240_b$ will be at the lower end of their respective chamber portions $238_a$ and $238_b$. These positions are designated respectively $P_{oa}$ for the free piston $240_a$ and position $P_{ob}$ for the free piston $240_b$. Usually, both boiler inlet valves $V_{10}$ will be opened to start the system. Because the piston $240_b$ is at postion $P_{ob}$, however, the outboard boiler inlet valve $V_{10}$ associated with the chamber portion $238_b$ will almost immediately close but will raise the pressure in the outboard working subchamber $142_b$. On the other hand, the free piston $240_a$ will be accelerated upwardly generally as shown by FIG. 8 and the outboard boiler valve $V_{10}$ will close in generally normal fashion. This will accelerate the free piston $249_a$ up into the vicinity of the abuttment shoulder 239 and cause a corresponding pressure rise between the opposed sides of the free pistons $240_a$ and $240_b$ to operate the inboard boiler inlet valve $V_{1I}$. The combination of the inertia of the free piston $240_b$ and the increase in pressure in the outboard working subchamber $242_b$ will ensure a pressure rise in the sapce between the pistons $240_a$ and $240_b$ to operate the inboard boiler inlet valve $V_{1I}$. When boiler valve $V_{1I}$ is activated, the boiler inlet valve $V_{1I}$ will introduce the boiler working fluid into both of the inboard working subchamber $246_a$ and $246_b$ to accelerate the pistons $240_a$ and $240_b$ outwardly of their outboard strokes and initiate the normal operation of the system. If the boiler pressure in the space between the pistons $240_a$ and $240_b$ on the initial stroke does not exceed boiler pressure, an appropriate control may be provided on the inboard boiler inlet valve $V_{1I}$ to ensure that it is activated on this first stroke.

It is further to be understood that any embodiments of the systems disclosed herein may be operated without allowing the pressure in the working subchambers whose volume is being reduced to rise above the boiler pressure by allowing the pressure in such working chamber to rise to boiler pressure and then expel working fluid back out through the associated boiler inlet valve into the boiler. This would cause the pressure in the working subchambers whose volumes are being reduced to never rise above boiler pressure. The operation of such modifications would be substantially the same as that shown except that additional free piston movement would be allowed in such systems.

While the specific embodiments disclosed herein show a cylinder with one or more free pistons therein as the expansion-compression device, it is to be understood that the inventive concept is not limited to the specific construction shown but may be incorporated into any structure whose principle of operation corresponds to that of the structure illustrated. One example of such a structure is a bellows that defines a chamber therein where the chamber varies in size in response to the linear movement of an operating mass toward and away from the chamber.

Also, the system disclosed combines the working fluid from the power loop with the working fluid from the heat pump loop in the expansion-compression device, passes the combined working fluids through the condenser, and then separates the working fluid of the power loop from the working fluid of the heat pump loop after passage through the condenser. Prior art systems, on the other hand, kept the working fluid from the power loop separated from the working fluid of the heat pump loop in the expansion-compression device, combined the power loop working fluid with the heat pump loop working fluid in the condenser, and then separates the loop working fluids after passage through the condenser. The system disclosed combines these loop working fluids in a single working chamber.

While specific embodiments of the invention have been disclosed herein, it is to be understood that full use may be made of modifications, substitutions and equivalents without departing from the scope of the invention.

We claim:

1. A method of operating a dual loop, single working fluid, a heat pump system which has a boiler; an evaporator; a condenser; and an expansion-compression device slidably mounting a free piston in a working chamber for linear movement of the free piston within the working chamber along the axis of the chamber so that the free piston divides the working chamber into a first subchamber of varying size and a second subchamber of varying size as the piston moves linearly within the chamber, where the high pressure outlet of the boiler is connected to the first subchamber, the outlet of the evaporator is connected to the first subchamber, and the inlet of the condenser is connected to the first subchamber, the method comprising the steps of:

a. pressurizing the second subchamber to urge the piston toward the first subchamber;

b. connecting the high pressure outlet of the boiler to the first subchamber to introduce working fluid from the boiler into the first subchamber to drive the piston linearly toward the second subchamber and induce linear kinetic energy in the piston while working fluid from the evaporator is prevented from entering the first subchamber and while the working fluid in the first subchamber is prevented from entering the condenser;

c. stopping the introduction of working fluid from the boiler into the first subchamber to allow the high pressure working fluid in the first subchamber to expand while the piston continues to move toward the second subchamber until the working fluid in the first subchamber has expanded to the pressure of the working fluid in the evaporator;

d. connecting the outlet of the evaporator to the first subchamber while the piston continues to move toward the second subchamber so that working fluid from the evaporator is drawn into the first subchamber to maintain the pressure in the first subchamber at the pressure of the working fluid in the evaporator as long as the piston moves toward the second subchamber with the pressure in the second subchamber being greater than the pressure of the working fluid in the first subchamber when the piston reaches its limit of movement toward the second subchamber so that the pressure of the working fluid in the second subchamber reverses the movement of the free piston and drives the free piston back toward the first subchamber while inducing linear kinetic energy in the piston; e. preventing the flow of working fluid from the first subchamber into the evaporator, from the boiler into the first subchamber, and from the condenser into the first subchamber as the free piston moves toward the first subchamber so that the pressure of the working fluid in the first subchamber is raised as the free piston moves toward the first subchamber; and, f. connecting the working fluid in the first subchamber to the inlet of the condenser when the working fluid in the first subchamber reaches the pressure of the condenser as the free piston moves toward the first subchamber so that the working fluid in the first subchamber is discharged into the condenser as the free piston continues to move towrd the first subchamber.

2. The method of claim 1 further including the step of preventing the flow of working fluid from the first subchamber into the inlet of the condenser after step (f) while the linear kinetic energy induced in the free piston continues to move the free piston toward the first subchamber to cause the pressure of working fluid in the first subchamber to rise to a level to stop the movement of the free piston toward the first subchamber.

3. The method of claim 2 wherein the step of preventing the flow of working fluid from the first subchamber into the inlet of the condenser includes absorbing the linear kinetic energy in the free piston in the working fluid in the first subchamber as potential energy with the pressure in the second subchamber being less than the pressure of the working fluid in the first subchamber when the piston reaches the limit of its movment toward the second subchamber so that the pressure of the working fluid in the second subchamber reverses the movement of the free piston and drives the free piston back towards the second subchamber.

4. The method of claim 1 wherein step (a) is performed by connecting the inlet of the condenser directly to the second subchamber.

5. The method of claim 1 wherein step (c) is performed by stopping the introduction of the working fluid from the boiler into the first subchamber in response to a prescribed velocity of the free piston.

6. The method of claim 1 wherein the high pressure outlet of the boiler is also connected to the second subchamber, the outlet of the evaporator is also connected to the second subchamber, and the inlet of the condenser is also connected to the second subchamber, and wherein step (a) comprises the substeps of:

$a_1$. connecting the high pressure outlet of the boiler to the second subchamber at approximately the limit of movement of the free piston toward the second subchamber to introduce working fluid from the boiler into the second subchamber to drive the piston linearly toward the first subchamber and induce linear kinetic energy in the piston while working fluid from the evaporator is prevented from entering the second subchamber and while the working fluid in the second subchamber is prevented from entering the condenser;

$a_2$. stopping the introduction of the working fluid from the boiler into the second subchamber to allow the high pressure working fluid in the second subchamber to expand while the piston continues to move toward the first subchamber until the working fluid in the second subchamber has expanded to the pressure of the working fluid in the evaporator;

$a_3$. connecting the outlet of the evaporator to the second subchamber while the piston continues to move toward the first subchamber so that the working fluid from the evaporator is drawn into the second subchamber to maintian the pressure in the second subchamber at the pressure of the working fluid in the evaporator as long as the piston moves toward the first subchamber with the pressure in the first subchamber being greater than the pressure of the working fluid in the second subchamber when the piston reaches its limit of movement toward the first subchamber so that the pressure of the working fluid in the first subchamber reverses the movement of the free piston and drives the free piston back toward the second subchamber while inducing linear kinetic energy in the piston;

$a_4$. preventing the flow of the working fluid from the second subchamber into the evaporator, from the boiler into the second subchamber, and from the condenser into the second subchamber as the free piston moves toward the second subchamber so that the pressure of the working fluid in the second subchamber is raised as the free piston moves toward the second subchamber; and, $a_5$. connecting the working fluid in the second subchamber to the inlet of the condenser when the working fluid in the second subchamber reaches the pressure of the condenser as the free piston moves toward the second subchamber so that the working fluid in the second subchamber is discharged into the condenser as the free piston continues to move toward the second subchamber.

7. The method of claim 6 wherein step (a) further includes the substep of preventing the flow of working fluid from the second subchamber into the inlet of the condenser after substep ($a_5$) while the linear kinetic energy induced in the free piston continues to move the free piston toward the second subchamber to raise the pressure of the working fluid in the second subchamber sufficiently to stop the movement of the free piston toward the second subchamber.

8. The method of claim 7 wherein substep ($a_2$) is performed by stopping the introduction of the working fluid from the boiler into the second subchamber in response to a prescribed velocity of the free piston.

9. In a heat pump system having evaporator means with an inlet and an outlet, condenser means with an inlet and an outlet, boiler means with an inlet and an outlet, expansion valve means connecting the condenser outlet to the evaporator inlet, liquid pump means connecting the condenser outlet to the boiler inlet, and a system working fluid, the improvement comprising:

a. an expansion-compression device defining a chamber therein and including a free-piston slidably carried in said chamber for linear movement therein, said free piston dividing said chamber into a first subchamber of carying size as said free piston moves and a second subchamber of varying size as said free piston moves;

b. first valve means for selectively introducing working fluid from the boiler outlet into said first subchamber;

c. second valve means for selectively introducing working fluid from the evaporator outlet into said first subchamber;

d. third valve means for selectively introducing working fluid from said first subchamber into the condenser inlet;

e. means for pressurizing said second subchamber to urge said free piston toward said first subchamber; and, f. control means for selectively causing said first valve means to introduce working fluid from the boiler means into the first subchamber to drive said free piston toward said second subchamber, for causing said second valve means to introduce working fluid from the evaporator means into said first subchamber when the pressure in said first subchamber drops below the pressure in the evaporator means, and for selectively causing said third valve means to connect said first subchamber to the condenser inlet when said free piston moves toward said first subchamber and when the pressure in the first subchamber rises to the pressure in the condenser means.

10. The heat pump system of claim 9 wherein said control means is constructed and arranged to cause said first valve means to introduce fluid from the boiler outlet into said first subchamber to drive said free piston toward said second subchamber and to stop the flow of working fluid from the boiler outlet into the first subchamber when said free piston is moving toward said second subchamber at a prescribed velocity.

11. The heat pump system of claim 10 wherein said means for pressurizing said second subchamber includes conduit means connecting said second subchamber directly to the condenser inlet.

12. The heat pump system of claim 10 wherein said means for pressurizing said second subchamber includes:

$e_1$. fourth valve means for selectively introducing working fluid from the boiler outlet into said second subchamber;

$e_2$. fifth valve means for selectively introducing working fluid from the evaporator outlet into said second subchamber;

$e_3$. sixth valve means for selectively introducing working fluid from said second subchamber into the condenser inlet; and, wherein said control means further causes said fourth valve means to introduce working fluid from the boiler means into the second subchamber to drive said free piston toward said first subchamber, causes said fifth valve means to introduce working fluid from the evaporator means into said second subchamber when the pressure in said second subchamber drops below the pressure in the evaporator means, and causes said sixth valve means to connect said second subchamber to the condenser inlet when said free piston moves toward said second subchamber and when the pressure in the second subchamber rises to the pressure in the condenser means.

13. A method of operating an expansion-compression device slidably mounting a free piston in a working chamber for linear movement of the free piston within the working chamber along the axis of the chamber so that the free piston divides the working chamber into a first subchamber of varying size and a second subchamber of varying size as the piston moves linearly within the chamber comprising the steps of:

a. pressurizing the second subchamber to urge the piston toward the first subchamber;

b. introducing working fluid at a first prescribed pressure greater than the pressure in the second subchamber into the first subchamber to drive the piston linearly toward the second subchamber and induce linear kinetic energy in the piston;

c. stopping the introduction of working fluid at the first prescribed pressure into the first subchamber to allow the working fluid in the first subchamber to expand while the piston continues to move toward the second subchamber until the working fluid in the first subchamber has expanded to a second prescribed pressure less than the first prescribed pressure;

d. connecting the first subchamber to a supply of working fluid at the second prescribed pressure while the piston continues to move toward the second subchamber so that working fluid from the supply is drawn into the first subchamber to maintain the pressure in the first subchamber at the second prescribed pressure as long as the piston moves toward the second subchamber with the pressure in the second subchamber being greater than the pressure of the working fluid in the first subchamber when the piston reaches its limit of movement toward the second subchamber so that the pressure of the working fluid in the second subchamber reverses the movement of the free piston and drives the free piston back toward the first subchamber while inducing linear kinetic energy in the piston;

e. preventing the flow of working fluid from the first subchamber as the free piston moves toward the first subchamber so that the pressure of the working fluid in the first subchamber is raised to a third prescribed pressure less than the first prescribed pressure and greater than the second prescribed pressure as the free piston moves toward the first subchamber; and, f. connecting the working fluid in the first subchamber to a receiver of working fluid at the third prescribed pressure when the working fluid in the first subchamber reaches the third prescribed pressure as the free piston moves toward the first subchamber so that the working fluid in the first subchamber is discharged into the receiver at the third prescribed pressure as the free piston continues to move toward the first subchamber.

14. A method of operating an expansion-compression device slidably mounting a free piston in a working chamber for linear movement of the free piston within the working chamber along the axis of the chamber so that the free piston forms a subchamber of varying size as the piston moves linearly within the chamber comprising the steps of:

a. discharging working fluid from the subchamber at a first prescribed pressure as the free piston moves toward the subchamber;

b. preventing the discharge of working fluid from the subchamber prior to the limit of movement of the free piston toward the subchamber to cause the pressure of the working fluid in the subchamber to be raised to a second prescribed pressure greater than the first prescribed pressure to stop the movement of the free piston toward the subchamber; and, c. introducing working fluid into the subchamber at the second prescribed pressure while the pressure in the subchamber is at the second prescribed pressure to move the free piston away from the subchamber without throttling losses.

15. A method of operating a dual loop, single working fluid, heat pump system where the power loop includes a boiler, a common expansion-compression device, and a common condenser; and where the heat pump loop includes an evaporator, the common expansion-compression device, and the common condenser comprising the steps of:

a. combining the power loop working fluid and the heat pump loop working fluid in the common expansion-compression device;

b. passing the combined power loop working fluid and heat pump loop working fluid from the common expansion-compression device through the common condenser; and, c. separating the power loop working fluid from the heat pump loop working fluid after passage through the common condenser.

16. A dual loop, single working fluid, heat pump system comprising;

a. an expansion-compression device including a linearly movable operating mass, said device defining a working chamber therein varying in size in response to linear movement of said operating mass;

b. boiler means;

c. condenser means;

d. evaporator means; and, e. valve means for selectively introducing working fluid from said boiler means into said working chamber for selectively introducing working fluid from said evaporator means into said working chamber, and for selectively introducing working fluid from said working chamber into said condenser.

17. A method of operating a dual loop, single working fluid, heat pump system with an expansion-compression device defining a working chamber therein and with a linearly movable operating mass varying the size of the working chamber in response to linear movement of the operating mass, a Rankine cycle power loop driving the expansion-compression device; and, a vapor compression heat pump loop driven by the expansion-compression device comprising the steps of:

a. introducing power loop working fluid into the working chamber to force the operating mass away from the working chamber;

b. introducing heat pump loop working fluid into the working chamber while the operating mass is moving away from the working chamber to combine the power loop working fluid in the working chamber with the heat pump loop working fluid; and, c. expelling the combined power loop working fluid and heat pump loop working fluid from the working chamber as the operating mass moves toward the working chamber.

* * * * *